United States Patent [19]

Matsumoto

[11] Patent Number: 4,868,754

[45] Date of Patent: Sep. 19, 1989

[54] METHOD OF STARTING THERMAL POWER PLANT

[75] Inventor: Hiroshi Matsumoto, Ibaraki, Japan

[73] Assignee: Hitachi, Ltd., Tokyo, Japan

[21] Appl. No.: 33,473

[22] Filed: Apr. 2, 1987

[30] Foreign Application Priority Data

Apr. 2, 1986 [JP] Japan ..... 61-76099
Apr. 10, 1986 [JP] Japan ..... 61-82973
Apr. 25, 1986 [JP] Japan ..... 61-94526

[51] Int. Cl.[4] ..... G06F 15/48; G05B 13/02

[52] U.S. Cl. ..... 364/431.01; 364/150; 364/494; 290/46; 60/646

[58] Field of Search ..... 364/431.01, 492–494, 364/148–153, 156; 290/40 R, 46, DIG. 1; 415/13, 17, 19, 47; 60/645, 646, 656; 73/112

[56] References Cited

U.S. PATENT DOCUMENTS 4,410,950 10/1983 Toyoda et al. ..... 364/492
4,607,325 8/1986 Horn ..... 364/494
4,612,621 9/1986 Kaya et al. ..... 364/494
4,687,946 8/1987 Jones ..... 364/494

OTHER PUBLICATIONS

Hanzalek et al, "Thermal Stresses Influence Starting, Loading of Bigger, Boilers, Turbines", *Electrical World*, vol. 165, No. 6, Feb. 1966.

*Primary Examiner*—Parshotam S. Lall
*Assistant Examiner*—Brian M. Mattson
*Attorney, Agent, or Firm*—Antonelli, Terry & Wands

[57] ABSTRACT

An initial start-up schedule is prepared based on given parameters relating to a thermal power plant and its operation. A dynamic characteristic model is prepared, permitting simulation of start-up characteristics which would be obtained if the thermal power plant is started according to the initial start-up schedule. Estimates are made of specified parameters, such as energy loss, the time interval between steam admission to an intermediate pressure turbine and steam admission to a high pressure turbine, and thermal stress of the power plant. Determination is made of whether the estimated values of the selected parameters are within predetermined allowable ranges or not. The initial start-up schedule is then corrected according to a predetermined rule depending upon whether the estimated values are determined to be within the predetermined allowable ranges or not. The estimating, determining, and correcting are repeated until an optimized start-up schedule is obtained.

7 Claims, 32 Drawing Sheets

FIG. 3

100

CONSTANTS

| SYMBOL | | VALUE | UNIT | MEANING |
|---|---|---|---|---|
| XD | XD(1) | 90. | sec | DESIGN VALUE OF IGNITOR IGNITION INTERVAL |
| | XD(2) | 420. | sec | DESIGN VALUE OF MILL STARTING INTERVAL |
| | XD(3) | 70. | % | DESIGN VALUE OF MAIN STEAM TEMPERATURE-UP RATE |
| | XD(4) | 70. | % | DESIGN VALUE OF REHEATED STEAM TEMPERATURE-UP RATE |
| XMAX | XMAX(1) | 180. | sec | MAX. VALUE OF IGNITOR IGNITION INTERVAL |
| | XMAX(2) | 780. | sec | MAX. VALUE OF MILL STARTING INTERVAL |
| | XMAX(3) | 100. | % | MAX. VALUE OF MAIN STEAM TEMPERATURE-UP RATE |
| | XMAX(4) | 100. | % | MAX. VALUE OF REHEATED STEAM TEMPERATURE-UP RATE |
| XMIN | XMIN(1) | 60. | sec | MIN. VALUE OF IGNITOR IGNITION INTERVAL |
| | XMIN(2) | 180. | sec | MIN. VALUE OF MILL STARTING INTERVAL |
| | XMIN(3) | 50. | % | MIN. VALUE OF MAIN STEAM TEMPERATURE-UP RATE |
| | XMIN(4) | 50. | % | MIN. VALUE OF REHEATED STEAM TEMPERATURE-UP RATE |
| K | | 8 | — | NUMBER OF APEXES OF SIMPLEX |
| TIBO | | 400. | °C | INITIAL TEMPERATURE OF INNER WALL OF IPT BOWL |
| THCI | | 400. | °C | INITIAL TEMPERATURE OF INNER WALL OF HPT CASING |
| TNUP | | 360. | sec | PREDICTED TIME INTERVAL FOR SPEED-UP CONTROL |
| TIL | | 1200. | sec | PREDICTED TIME INTERVAL FOR INSERTION OF LOAD |
| TLUP | | 360. | sec | PREDICTED TIME INTERVAL FOR LOAD-UP CONTROL |
| TCS | | 180. | sec | CONTROL PERIOD |
| DN(I) | DN(1) | 300. | rpm/min | ASSUMED SPEED-UP RATE VALUE |
| | DN(2) | 200. | rpm/min | 〃 |
| | DN(3) | 100. | rpm/min | 〃 |
| | DN(4) | 0. | rpm/min | 〃 |
| DL(I) | DL(1) | 5. | %/min | ASSUMED LOAD VARIATION RATE VALUE |
| | DL(2) | 3. | %/min | 〃 |
| | DL(3) | 1. | %/min | 〃 |
| | DL(4) | 0. | %/min | 〃 |
| TNVARY | | 180. | sec | INTERVEL FOR SPEED VARIATION |
| TLVARY | | 60. | see | INTERVEL FOR LOAD VARIATION |
| DTP | | 30. | sec | PLANT MODEL CALCULATION PERIOD |
| RO | | 1.3 | sec | STANDARD VALUE FOR PROLONGATION FACTOR |
| | | | | |
| | | | | |

INITIAL VALUES

| SYMBOL | VALUE | MEANING |
|---|---|---|
| NKAD | 0 | TIMES OF SUCCESSFUL TRIALS AT XK+1 |
| NKNG | 0 | TIMES OF FAILED TRIALS AT XK+1 |
| NEAD | 0 | TIMES OF SUCCESSFUL TRIALS AT XE |
| NENG | 0 | TIMES OF FAILED TRIALS AT XE |
| NCAD | 0 | TIMES OF SUCCESSFUL TRIALS AT XC |
| NCNG | 0 | TIMES OF FAILED TRIALS AT XC |
| NSAD | 0 | TIMES OF SUCCESSFUL REDUCTION |
| NSNG | 0 | TIMES OF FAILED REDUCTION |
| | | |
| | | |

FIG. 5

160

NSP : STARTUP PHASE NO.
NMV : MONITORING VARIABLE NO.
IVIC : FLAG OF IMPLICIT CONSTRAINT VIOLATION

| PHASE | | | | BOILER START-UP | SPEED-UP | LOAD-UP | IMPLICIT CONSTRAINTS Y(NMV) | |
|---|---|---|---|---|---|---|---|---|
| | | | | IGNITION-METAL MATCHED | STEAM ADMISSION-RATED SPEED | LOAD INSERTION-RATED LOAD | VALUE | UNIT |
| DISCRIMINATION OF PHASE | | | | N = 0 | N ≠ 0 AND L = 0 | L = 0 | | |
| PHASE No. (NSP) | | | | 1 | 2 | 3 | | |
| OPERATION LIMITING FACTOR Y(NMV) | | | NMV | POSSIBILITY OF ON-LINE CONTROL (◎ POSSIBLE, ○ IMPOSSIBLE) | | | | |
| BOILER HEADER | INNER SURFACE | COMPRESSIVE STRESS | 1 | ○ | ◎ | ◎ | >−35. | kg/mm² |
| | | TENSILE STRESS | 2 | ○ | ◎ | ◎ | < 35. | " |
| | OUTER SURFACE | COMPRESSIVE STRESS | 3 | ○ | ◎ | ◎ | >−35. | " |
| | | TENSILE STRESS | 4 | ○ | ◎ | ◎ | < 35. | " |
| HPT ROTOR | SURFACE | COMPRESSIVE STRESS | 5 | | | ◎ | >−25.3 | " |
| | | TENSILE STRESS | 6 | | | ◎ | < 25.3 | " |
| | BORE | COMPRESSIVE STRESS | 7 | | | ◎ | >−37.98 | " |
| | | TENSILE STRESS | 8 | | | ◎ | <37.98 | " |
| (IPT) ROTOR | SURFACE | COMPRESSIVE STRESS | 9 | | ◎ | ◎ | >−25.3 | " |
| | | TENSILE STRESS | 10 | | ◎ | ◎ | < 25.3 | " |
| | BORE | COMPRESSIVE STRESS | 11 | | ◎ | ◎ | >−37.98 | " |
| | | TENSILE STRESS | 12 | | ◎ | ◎ | <37.98 | " |
| DRUM STEAM TEMP. VARIATION RATE | | | 13 | ○ | ◎ | ◎ | <0.056 | °C/S |
| METAL TEMPERATURE OF HEAT CONDUCTION TUBE (2-RH METAL TEMP.) | | | 14 | ○ | ◎ | ◎ | < 650 | °C |
| HPT BYPASS FLOW | | | 15 | ○ | ◎ | ◎ | >80. | kg/S |
| LPT BYPASS FLOW | | | 16 | ○ | ◎ | ◎ | <80. | kg/S |

IVIC(NMV) = { 1 — VIOLATION OF CONSTRAINT; 0 — SATISFACTION OF CONSTRAINT }

* LCFI = 0.05 EQUIVALENT

FIG. 8

260

| STARTUP PHASE | | | | NSP = 1 | | | | NSP = 2 | | | | NSP = 3 | | | |
|---|---|---|---|---|---|---|---|---|---|---|---|---|---|---|---|
| OPERATION LIMIT FACTORS | | OPTIMIZING PARAMETERS | NO. / NAME | I=1 IGNITOR IGNITION INTERVAL | I=2 MILL STARTING INTERVAL | I=3 MAIN STEAM TEMPERATURE -UP RATE | I=4 REHEATED STEAM TEMPERATURE -UP RATE | I=1 IGNITOR IGNITION INTERVAL | I=2 MILL STARTING INTERVAL | I=3 MAIN STEAM TEMPERATURE -UP RATE | I=4 REHEATED STEAM TEMPERATURE -UP RATE | I=1 IGNITOR IGNITION INTERVAL | I=2 MILL STARTING INTERVAL | I=3 MAIN STEAM TEMPERATURE -UR RATE | I=4 REHEATED STEAM TEMPERATURE -UP RATE |
| BOILER HEADER | INNER SURFACE | COMPRESSIVE STRESS | NMV=1 | ◎ | ◎ | × | × | O | ◎ | × | × | △ | O | ◎ | △ |
| | | TENSILE STRESS | 2 | ◎ | ◎ | × | × | O | ◎ | × | × | △ | O | ◎ | △ |
| | OUTER SURFACE | COMPRESSIVE STRESS | 3 | ◎ | ◎ | × | × | O | ◎ | × | × | △ | O | ◎ | △ |
| | | TENSILE STRESS | 4 | ◎ | ◎ | × | × | O | ◎ | × | × | △ | O | ◎ | △ |
| HPT ROTOR | INNER SURFACE | COMPRESSIVE STRESS | 5 | × | × | × | × | × | × | × | × | △ | O | ◎ | △ |
| | | TENSILE STRESS | 6 | × | × | × | × | × | × | × | × | △ | O | ◎ | △ |
| | OUTER SURFACE | COMPRESSIVE STRESS | 7 | × | × | × | × | × | × | × | × | △ | O | ◎ | △ |
| | | TENSILE STRESS | 8 | × | × | × | × | × | × | × | × | △ | O | ◎ | △ |
| IPT ROTOR | INNER SURFACE | COMPRESSIVE STRESS | 9 | × | × | × | × | O | ◎ | × | × | △ | O | ◎ | ◎ |
| | | TENSILE STRESS | 10 | × | × | × | × | O | ◎ | × | × | △ | O | ◎ | ◎ |
| | OUTER SURFACE | COMPRESSIVE STRESS | 11 | × | × | × | × | O | ◎ | × | × | △ | O | ◎ | ◎ |
| | | TENSILE STRESS | 12 | × | × | × | × | O | ◎ | × | × | △ | O | ◎ | ◎ |
| DRUM STEAM TEMP. VARIATION RATE | | | 13 | ◎ | ◎ | × | × | O | ◎ | × | × | △ | O | ◎ | △ |
| METAL TEMPERATURE OF HEAT CONDUCTION TUBE (2-RH METAL TEMP.) | | | 14 | ◎ | ◎ | × | × | O | ◎ | × | × | △ | O | ◎ | ◎ |
| HPT BYPASS FLOW | | | 15 | ◎ | ◎ | × | × | O | ◎ | × | × | △ | ◎ | × | × |
| LPT BYPASS FLOW | | | 16 | ◎ | ◎ | × | × | O | ◎ | × | × | △ | ◎ | × | × |

| SYMBOLS | ◎ | O | △ | × |
|---|---|---|---|---|
| SENSITIVITY | HIGH | MEDIAM | LOW | ZERO |
| PROLONGATION FACTOR CORRECT COEFFICIENT D(I) | 0.5 | 0.7 | 0.9 | 1.0 |

700

130

(a) EXCLUSION OF WORST POINT (E)

(EXCLUSION OF XS AND ADDITION OF XE)

(b) EXCLUSION OF WORST POINT (K)

(EXCLUSION OF XS AND ADDITION OF XK+1)

(c) EXCLUSION OF WORST POINT (C)

(EXCLUSION OF XS AND ADDITION OF XC)

METHOD OF STARTING THERMAL POWER PLANT

BACKGROUND OF THE INVENTION

The present invention generally relates to a method of starting a thermal power plant. More particularly, the invention is concerned with a thermal power plant start-up method which can satisfy at least one of various basic conditions for starting up the thermal power plant while abiding by the constraint conditions imposed on the plant start-up.

According to a hitherto known method of starting a thermal power plant, a start-up schedule is prepared by incorporating the initial amount of fuel to be charged into a boiler, temperature-up and pressure-up of main steam as a function of time, as well as load-up and speed-up of turbines as a function of time in consideration of the rest time of he power plant preceding to the start-up and temperature states of instruments and machineries, the start-up schedule thus prepared being then executed by control systems provided in various systems of the thermal power plant. One of the most typical methods is described in an article entitled "Thermal Stresses Influence Starting, Loading of Bigger Boilers, Turbines" in "Electrical World", Vol. 165, No. 6.

The known method mentioned above resides in that the start-up schedule is definitely determined in dependence on the initial states of a limited number of locations of the power plant. More specifically, according to this known method, the warm-up time of the steam turbine and the load variation rate are determined in accordance with the initial values of boiler steam pressure, boiler exit steam temperature and the temperature of steam turbine casing by correspondingly determining the speed-up rate of the steam turbine and the initial load and holding the speed and load at respective constant values. Since dispersion of the temperature-up characteristics of the steam generated by the boiler is accommodated in a margin of the start-up schedule according to this method, the start-up schedule as prepared tends to be excessively lengthy. This, in turn, means that the starting loss (i.e. loss involved in the start-up process of the thermal power plant) also tends to be increased. Other methods known heretofore are disclosed in U.S. Pat. Nos. 3,446,224 and 4,228,359. These known methods are directed to quick starting of the steam turbine by monitoring on-line the thermal stress produced in the steam turbine on the real time basis. However, according to these methods, the starting loss can not necessarily be reduced to a minimum. Further, consideration is paid neither to the method of abiding by the preset or commanded starting time nor to the method of starting the boiler system.

As the hitherto known method, there can be mentioned a method disclosed in Japanese Patent Application Laid-Open No. 157402/1984 (JP-A-59-157402). This method is directed to the quick temperature-up of the steam generated by the boiler by monitoring on-line the thermal stress produced in the boiler on a real time basis. However, this method does not necessarily reduce the starting loss to a minimum. Besides, no teachings are found as to the method of abiding by the designated starting time and the start-up of the turbine.

There has been proposed a thermal power plant starting system in which a turbine bypass system is provided and in which the plant start-up is effectuated by starting first the intermediate pressure turbine (reference may be made to Japanese Patent Laid-Open Application JP-A-57-93611, Published on June 10, 1982). According to this method, initial steam admission is made to the intermediate pressure turbine under the condition that the predetermined metal matching condition is fulfilled, to thereby speed up the turbine at a predetermined rate. However, since the temperature-up characteristics of the boiler differ from one to another starting, the speed-up rate is determined with a large margin for accommodating the difference or deviations of the temperature-up characteristics. Consequently, the speed-up of the power plant by means of the intermediate pressure turbine takes excessive time. As a result, the initial steam admission to the high pressure turbine upon completion of the speed-up process tends to be accompanied with a delay relative to the temperature-up of the boiler, giving rise to thermal shock to the high pressure turbine. In the worst case, a chance for metal matching may be missed or the plant start-up will result in failure.

As will be seen, any one of the hitherto known methods is concerned with the quick starting system in which either only the boiler or alternatively only the steam turbine is considered. Combinations of these discrete methods can not always solve the basic problem in the thermal power plant, i.e. starting of the power plant within a predetermined or fixed time with the minimum starting loss or reduction of the starting loss and life shortening of the machinery or starting within the shortest time while satisfying various conditions as imposed when the whole thermal power plant is considered comprehensively. This is because an extremely strong mutual interference exists between the boiler and the steam turbine, which means that individual optimization of the boiler and/or steam turbine can not always lead to optimization of the whole system. The basic problems imposed on the start-up system for the thermal power plant are to realize the following requirements:

(1) Quick start (start-up within a short time)

The starting time is generally defined to be a time required from the ignition of the boiler to a time point at which a demanded or target load (commanded from a power supply control center) has been attained;

(2) Completion of starting at a fixed time (fixed time start-up)

Completion of the start-up process generally means the attainment of the target load. In some cases, completion of the start-up process is defined to be accomplished at the time point when load is inserted or thrown in;

(3) Reduction of starting loss (low-loss start-up)

The starting loss is defined to be the portion of all energy supplied to the thermal power plant in the start-up process which does not contribute to the generation of electric power; and (4) Maintenance of operation limiting conditions with high fidelity The reasons which necessitate the realization of the requirements mentioned above are as follows:

(1) Quick start

When the time taken for starting the individual plants can be reduced, advantages mentioned below are obtained:

(i) Power supply stability (load follow-up capability) of the power system is enhanced.

(ii) Most of the thermal power plants except for those of great capacity (higher than 600 MW) are stopped in the nighttime and require about two hours for the starting. According to the teaching of the invention, it is expected that the starting time can be decreased about 30 minutes (about 25%), whereby the burden imposed on the operators can be correspondingly reduced.

(iii) Because there exists a strong correlation between the starting time and the starting loss, decreasing in the starting time will necessarily result in reduction of the starting loss, as mentioned below in the paragraph (3).

(2) Completion of starting at a fixed time

When the starting of each plant can be completed within a time designated or commanded from the power supply control center, advantages mentioned below are obtained:

(i) Since economical load distribution on the electric power system can be realized as scheduled, operation with the highest efficiency and reduction of loss in power flow can be accomplished.

(ii) Since the time point at which the plant inspection and operation performed by the operator are fixed, the burden imposed on the operators can be reduced, while assuring improved safety.

(3) Reduction of starting loss

The amount of fuel charged into the boiler upon starting of the power plant which effectively contributes to the generation of electricity is only 5% to 10% of the total amount of fuel, with a major portion of fuel being lost. By way of example, in the case of a plant of 500 MW class, the rate of fuel charged upon starting up the plant amounts to an enormous quantity of about 10 kg/sec (about 36 tons/hour). When the invention is applied, the fuel cost corresponding to 16 to 17 tons can be saved for each starting of the plant for the reasons (ii) and (iii) mentioned in the preceding section (1).

(4) Maintenance of operation limiting (constraint) conditions with high fidelity For realizing the aforementioned requirements (1), (2) and (3), it is necessary to extract the potential capability of the plant to a maximum. To this end, the operation limiting conditions (constraints) have to be abided by so that the operation limiting conditions or constraints are not violated by various process variables such as thermal stress of the turbine, metal temperature, steam temperature and others in the course of the start-up process.

SUMMARY OF THE INVENTION

An object of the present invention is to provide a method of starting a thermal power plant in such a manner that at least one of the basic requirements described hereinbefore can be satisfied, while abiding by the aforementioned operation limiting conditions by taking into consideration the interaction in the starting characteristics between the boiler and the steam turbine.

With a first embodiment of the present invention, it is intended as the basic object thereof to accomplish the reduction of the starting loss and fixation of the time point at which the starting process is completed.

Further, according to a second embodiment of the invention, it is intended as the basic object thereof to realize reduction of the starting loss and minimization of the life shortening of machinery.

With a third embodiment of the present invention, it is intended to accomplish the basic object of starting up the thermal power plant within the shortest time possible in particular in such a thermal power plant in which the intermediate pressure turbine preference starting system and the metal matching control system are adopted.

According to the invention, a dynamic plant characteristic model is prepared for making a decision prior to the actual plant starting as to whether the process state values satisfy the operation limiting conditions or constraints throughout the whole starting-up process, to thereby determine and execute the optimum start-up schedule through a so-called hill climbing method with the aid of the dynamic plant characteristic model.

BRIEF DESCRIPTION OF THE DRAWINGS

FIG. 3 sets forth tables listing constants and initial values as well as symbols;

FIG. 5 is a table illustrating limiting or constraint conditions;

FIGS. 8 to 10 are a table and two flow charts illustrating operation limiting factors and monitoring of algorithms;

DESCRIPTION OF THE PREFERRED EMBODIMENTS

Figure 1:
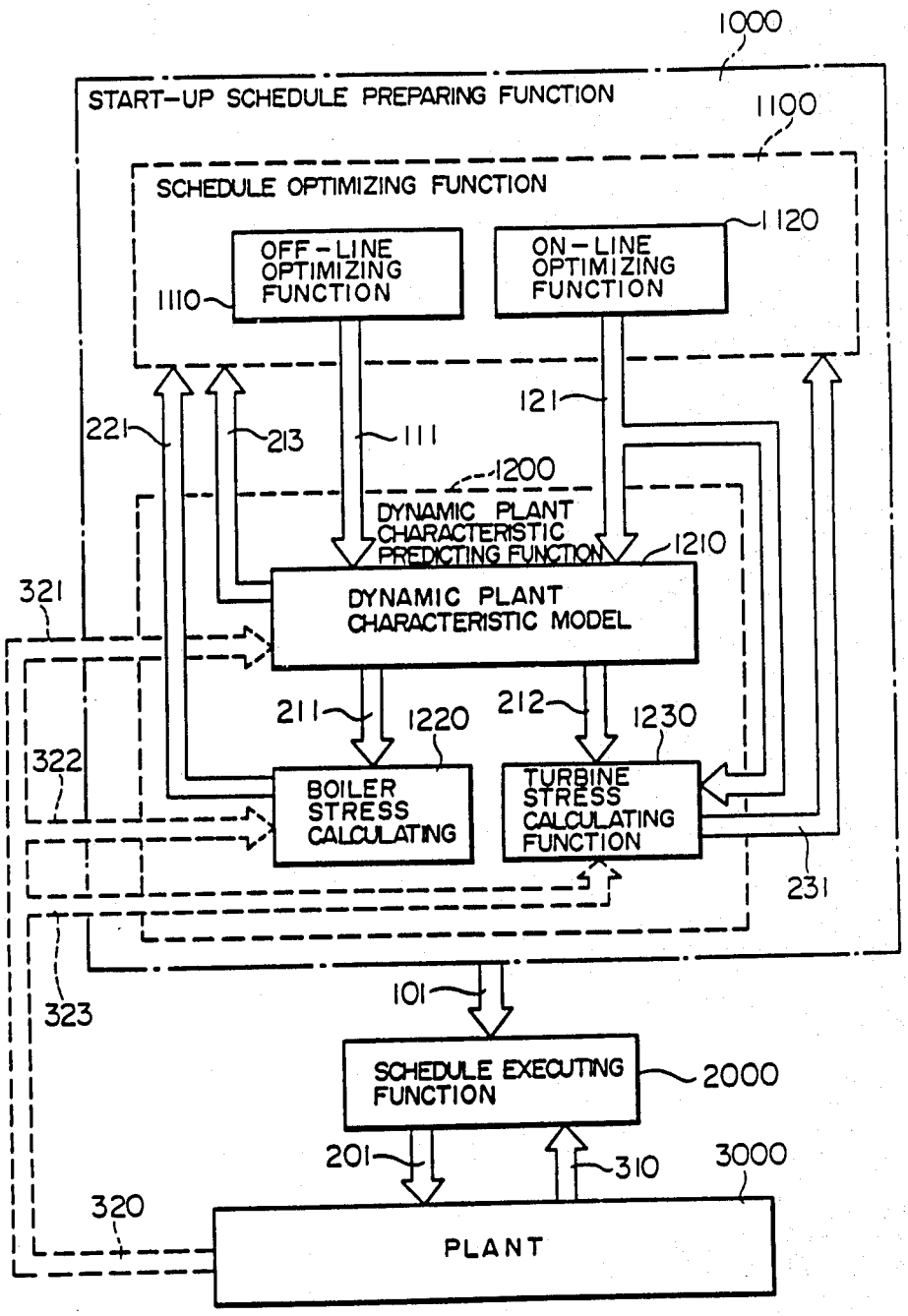
FIG. 1 is a block diagram showing a structure of basic functions executed in carrying out the method of starting a thermal power plant according to the present invention.

FIG. 1 shows in a functional block diagram a general arrangement of a system for carrying out a method of starting up a thermal power plant according to the present invention, which system can be employed in any one of the first, second and third embodiments of the invention. The system function may be classified into a start-up schedule preparation function 1000 and a schedule executing function 2000. The start-up schedule preparation function resides in preparing an optimum start-up schedule 101 which can minimize the starting loss involved in the plant start-up, while the schedule executing function 2000 serves to alter from time to time those control quantities which are required for actually starting up a thermal power plant 3000 in conformance with the optimal start-up schedule.

The start-up schedule preparing function 1000 includes a schedule optimizing function 1100 and a dynamic plant characteristic predicting function 1200. Further, the schedule optimizing function is composed of an off-line optimizing function 1100 and an on-line optimizing function 1120, while the dynamic plant characteristic predicting function 1200 is composed of a dynamic plant characteristic model 1210, a boiler stress calculating function 1220, and a turbine stress calculating function 1230. With the off-line optimization function 1110, a start-up schedule 111 is presumed and reflected onto the dynamic plant characteristic model 1210 to thereby simulate the start-up characteristics as indicated by 211, 212 and 213. On the other hand, the boiler stress calculation function 1220 serves to arithmetically determine the boiler stress as indicated by 221, while the turbine stress calculation function 1230 serves to calculate the turbine stress as indicated by 231. On the other hand, the on-line optimization function 1120 serves to optimize sequentially the desired turbine operating state in consideration of the calculated turbine stress 231, as indicated by 121 when the dynamic plant characteristic model 1210 becomes operative. Then, the off-line optimization function 1110 is utilized to evaluate the starting loss involved in the start-up process as well as the behavior of the process variables arithmetically derived from the execution of the function mentioned above and which variables relate to the operation limiting conditions. On the basis of the results of the evaluation, another start-up schedule 111 is newly prepared presumptively to be incorporated in the dynamic plant characteristic model 1210. By the term "starting loss", it is intended to mean a difference value obtained by subtracting the electric output power from the amount of heat generated through combustion of fuel consumed throughout the whole start-up process. By repeating the processing described above, the optimal start-up schedule 101 can be determined which can ensure the start-up operation is completed with minimum loss without being attended with violation of the operation limiting conditions. The optimal start-up schedule 101 as determined is set to the schedule executing function 2000 and utilized as the target values in the actual start-up process for the thermal power plant. It should be mentioned here that the dynamic plant characteristic model 1210, the boiler stress calculation function 1220, and the turbine stress calculation function 1230 require respective initial values 321, 322 and 323 which represent the process states measured prior to the start-up operation.

Now, the parameters which participate in determining the start-up schedule according to the illustrated embodiment of the present invention will be defined. Since the starting loss of the thermal power plant depends basically on the temperature characteristics of the plant, those parameters which have close dependence relation with the temperature-up characteristics of the plant should be selected. Based on this fundamental concept, there are selected four parameters, i.e. ignitor ignition interval ($T_{LG}$), mill start-up interval ($T_{PLV}$), temperature-up rate (rate of temperature rise) of main steam ($L_{TMS}$) and temperature-up rate of the reheated steam ($T_{RHH}$).

By the phrase "ignitor ignition interval", it is intended to mean the interval at which the ignitors provided in association with the individual burner stages of the boiler are sequentially energized at this time interval ($T_{IG}$) in response to the boiler ignition command to thereby fire the associated light-oil burners.

The phrase "mill start-up interval ($T_{PLV}$)" is intended to mean the time interval at which the pulverizing mills are started sequentially after all the light-oil burners have been ignited. In this case, each of the first and second mills supplies 50% of the rated output of the pulverized coal in dependence on the operation standards which are so established that the total flow of pulverized coal charged into the boiler amounts to 40% of the rated value when the third mill is put into operation (at this time point, the output of each mill is 67% of the respective rated value). The turbine is then started. When the output power of the electric generator has attained 40% of the rated value, the operation mode is transferred to the normal on-load operation mode. In this state, the remaining mills are actuated in dependence on the load demand, wherein five mills at maximum can ultimately be put into operation. As the mills are actuated successively in this manner, the aforementioned light-oil burners are correspondingly taken out of the operation.

The temperature-up rate of the main steam ($L_{TMS}$) is a parameter representative of the rate at which the temperature of main steam is increased in the normal on-load operation range (where the load ratio is 40% to 100%) and has a relation to the target temperature value of the main steam $T_{MSSET}$ arithmetically determined through the schedule execution function 2000, which relation is given by $$T_{MSSET} = MIN\left[\left\{T_{MS40} + \frac{T_{MSR} - T_{MS40}}{L_{MTS} - 40}(L - 40)\right\}, T_{MSR}\right] \quad (1)$$

where $T_{MS40}$: temperature (°C.) of the main steam at the time when 40% of load has been attained, $T_{MSR}$: rate temperature value (°C.) of the main steam, and L: load ratio (%).

MIN. in MIN [A, B]: any smaller one of A and B.

In other words, when the load has attained the level $L_{TRH}$ (%), this means that the temperature of the main steam should be made to attain the rated value.

The temperature-up rate of the reheated steam ($L_{TRH}$) is a parameter indicative of the rate at which the temperature of the reheated steam increases as in the case of the temperature-up rate parameter of the main steam. This parameter has a relation to the target temperature value $T_{RHSE}$ of the reheated steam arithmetically determined through the schedule executing function 2000, which relation is given by $$T_{RHSET} = MIN\left[\left\{T_{RH40} + \frac{T_{RHR} - T_{RH40}}{L_{TRH} - 40}(L - 40)\right\}, T_{RHR}\right] \quad (2)$$

where $T_{RH40}$: temperature (°C.) of the reheated steam at the time when the load level of 40% has been attained;

$T_{RHR}$: rated temperature value (°C.) of reheated steam; and

L: Load (%).

In other words, the above expression means that the temperature of the reheated steam should attain the rated value when the load has reached the level LTRH (%).

Next, description will be made in detail of the optimization algorithm employed in the off-line optimization function 1110.

Figure 2A:
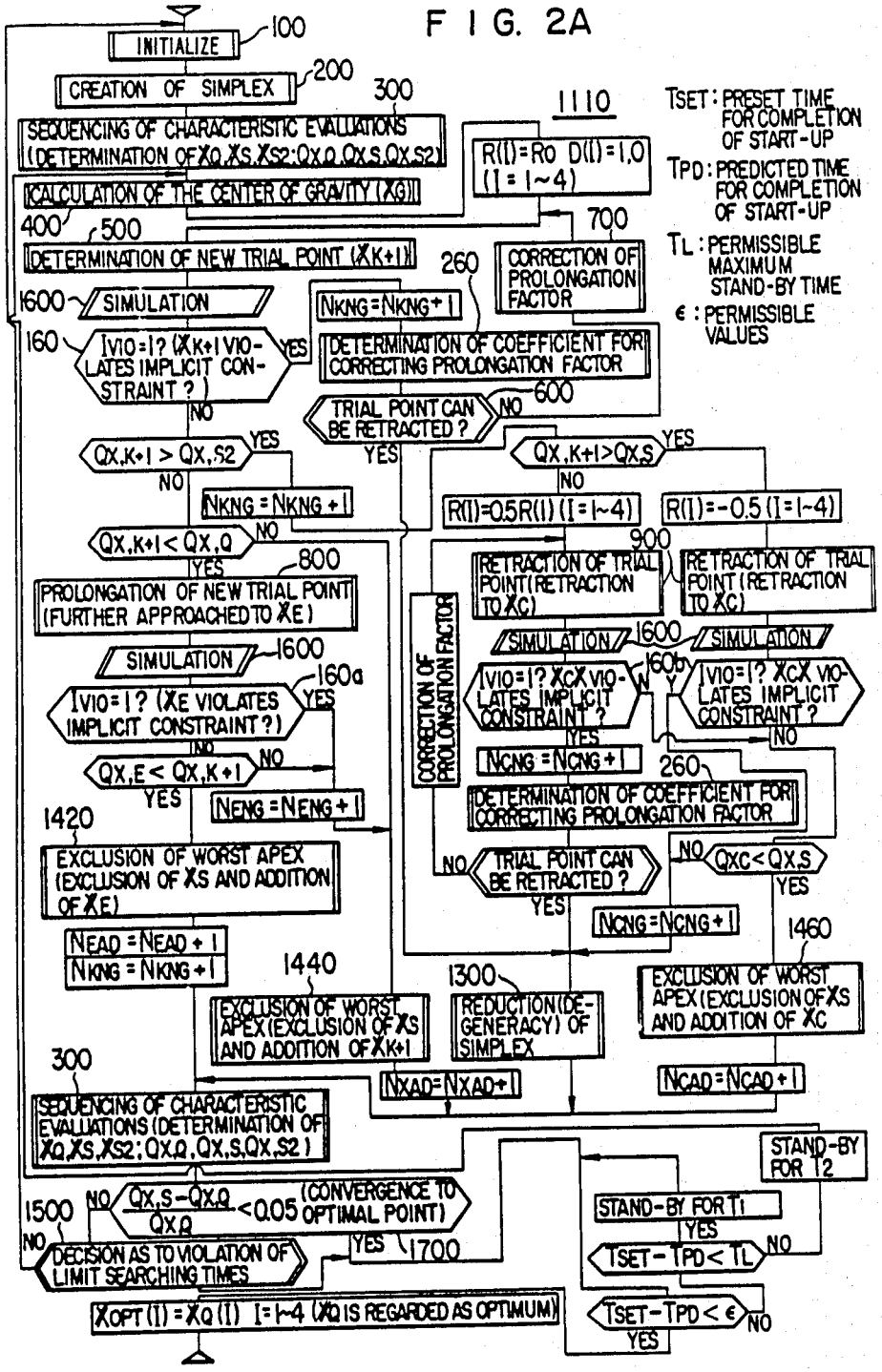
FIGS. 2A, 2B and 2C are flow charts illustrating procedures for processing start-up schedule optimizing algorithms according to first, second and third exemplary embodiments of the invention, respectively.
Figure 2B:
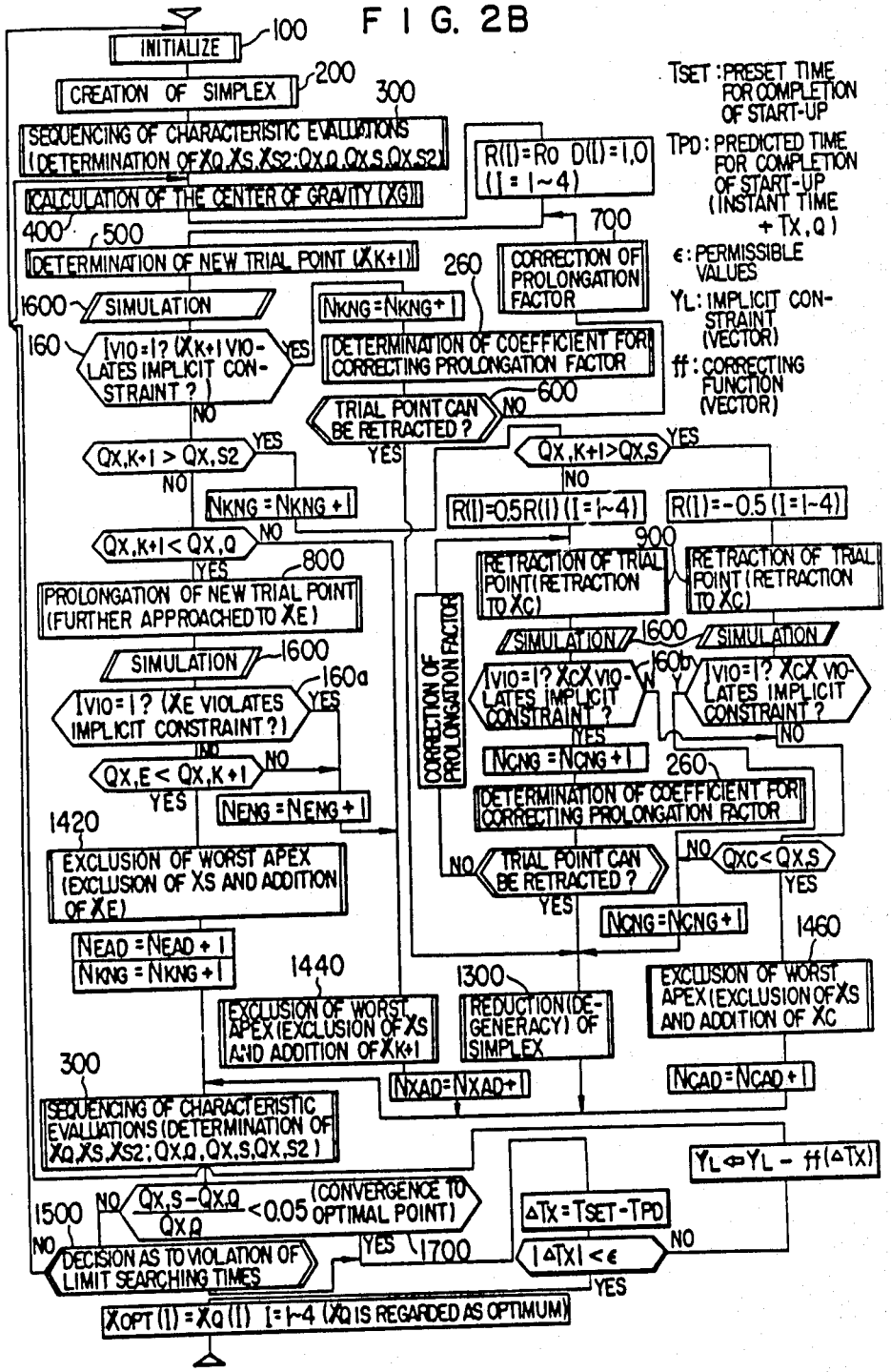
Figure 2C:
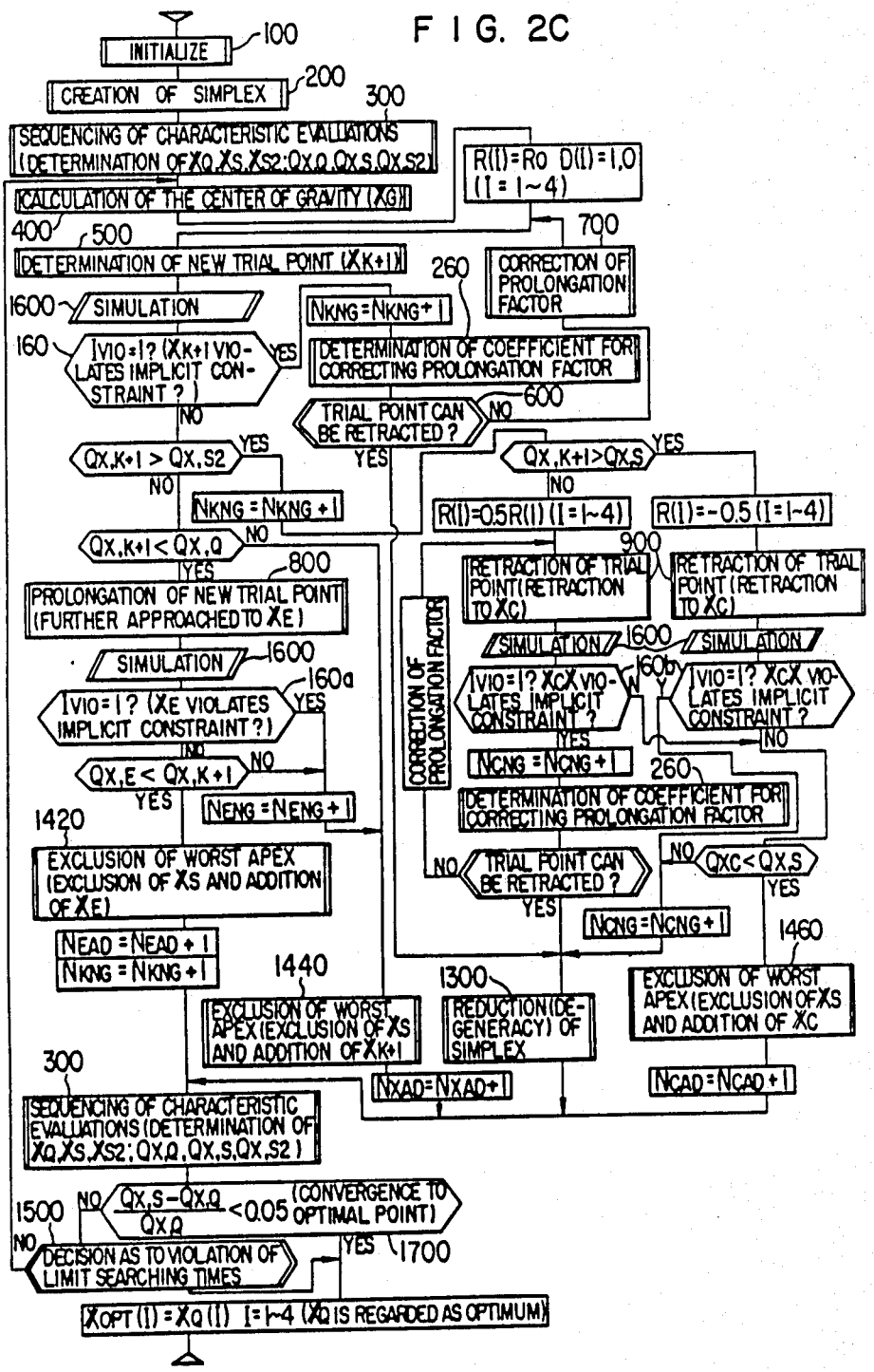

FIGS. 2A, 2B and 2C illustrate, respectively, fundamental processing procedures for the start-up schedule optimization algorithm adopted according to the first, second and third exemplary embodiments of the invention in which a simplex method, one of the non-linear optimization methods, is, made use of. It is assumed that the schedule parameter of concern is expressed as follows:

$$X = [X(1), X(2), X(3), X(4)]^t = [T_{IG}, T_{PLV}, L_{TMS}, L_{TRH}]^t \quad (3)$$

It should be mentioned here that the processing procedures illustrated in FIGS. 2A, 2B and 2C are based on substantially the same principle except for the steps 1700 et seq., although difference is found in that the procedures illustrated in FIG. 2A and 2B are directed to the starting loss ($Q_X$) as the objective for evaluation while the procedure illustrated in FIG. 2C is directed to the starting time ($T_X$) (i.e. the time taken for the start-up). Accordingly, it should be understood that the following description can be applied in common to the procedures illustrated in FIGS. 2A, 2B and 2C unless otherwise specified.

In the following, the individual processing functions will be set forth.

(1) Initialize 100

Constants and initial values used in the optimization algorithm are shown in FIG. 3 together with symbols, values, units and their meanings.

(2) Creation of initial simplex 200

Figure 4:
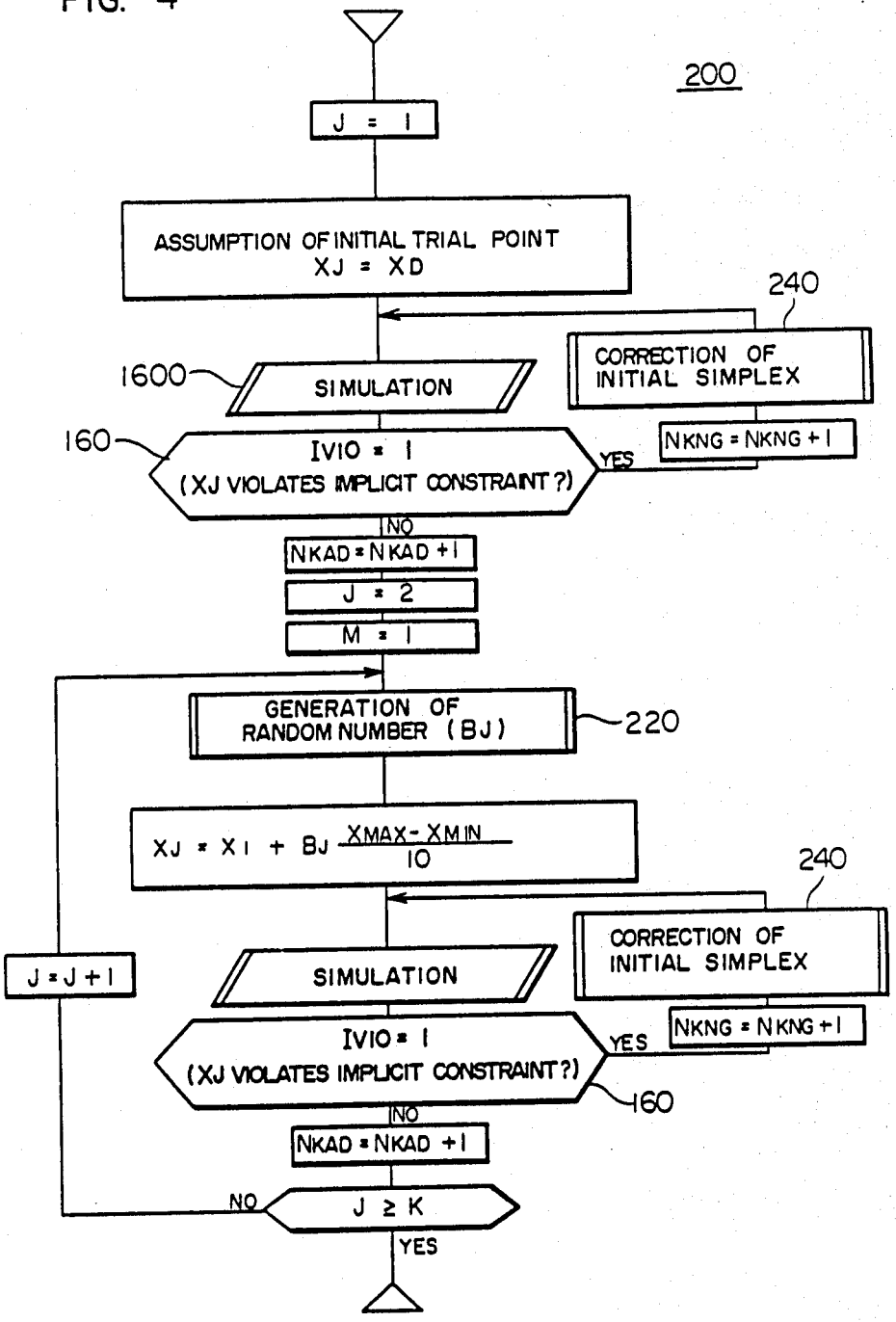
FIG. 4 is a flow chart illustrating a procedure for processing an initial simplex.
Figure 6:
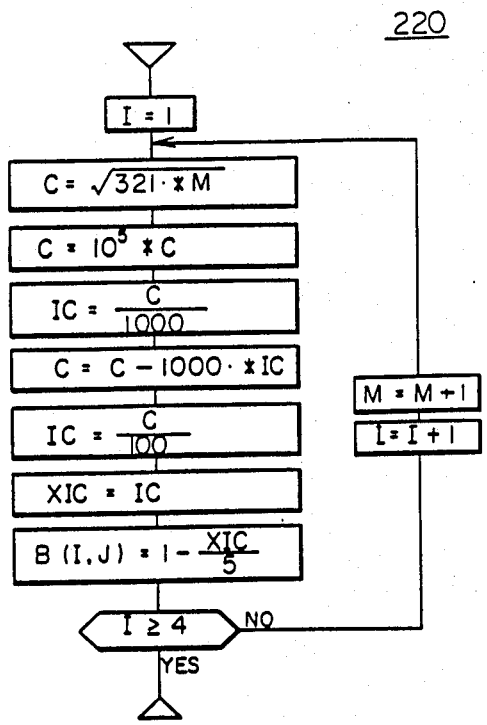
FIG. 6 is a flow chart illustrating a procedure for determining a pseudo-random number.

The processing procedure is illustrated in FIG. 4. A design value $X_D$ is set at an initial trial point $X_1$ for executing simulation which is to predict the plant start-up characteristics upon start-up of the thermal power plant in accordance with the start-up schedule $X_D$ by activating the dynamic plant characteristic predicting function 1200. At that time, unless an operation limit factor $Y(N_{MV})$ to the initial trial point $X_1$ violates the implicit constraint $Y_L(N_{MV})$ (refer to FIG. 5), the initial simplex is formed in the vicinity of the trial point $X_1$ in accordance with $$X_J = X_1 + B_3 \frac{X_{MAX} - X_{MIN}}{10} \quad (4)$$

where $B_J$ represents a pseudo-random number which satisfies the condition that $-1 \leqq B_N \leqq 1$, which random number is determined through the procedure illustrated in FIG. 6. When the initial simplex violates the implicit constraint, the trial point is corrected through the procedure illustrated in FIG. 7.

(a) Generation of random number 220 (FIG. 6)

FIG. 6 shows a procedure for arithmetically determining the pseudo-random number with a variable M being used. In this algorithm, a numeral appearing at the fifth position of a square root as counted from the most significant position is used.

Figure 7:
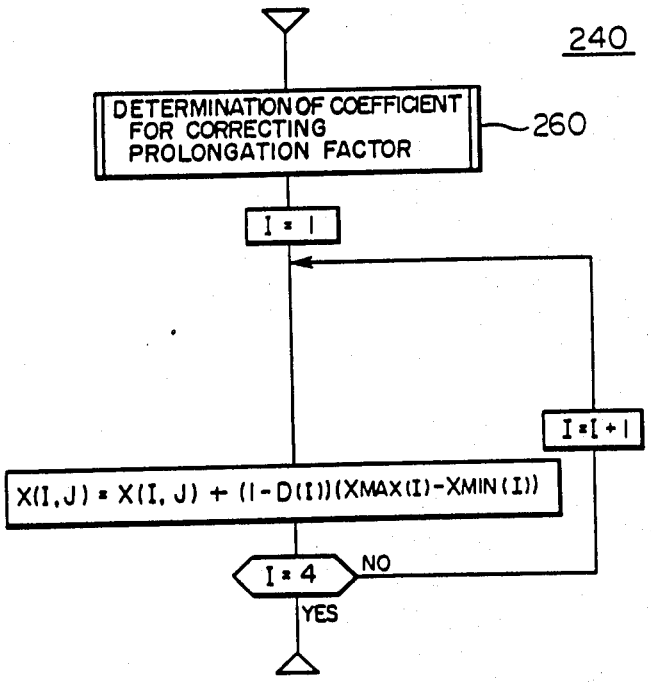
FIG. 7 is a flow chart illustrating a procedure performed when implicit constraints of XJ is not satisfied.

(b) Correction of the initial simplex 240 (FIG. 7)

On the basis of a prolongation factor correcting coefficient D(I), the trial point X(I, J) is corrected as follows:

$$X(I, J) = X(I, J) + (1 - D(I))(X_{MAX}(I) - X_{MIN}(I)) \quad (5)$$

(c) Determination of the prolongation factor correcting coefficient 260

Figure 9:
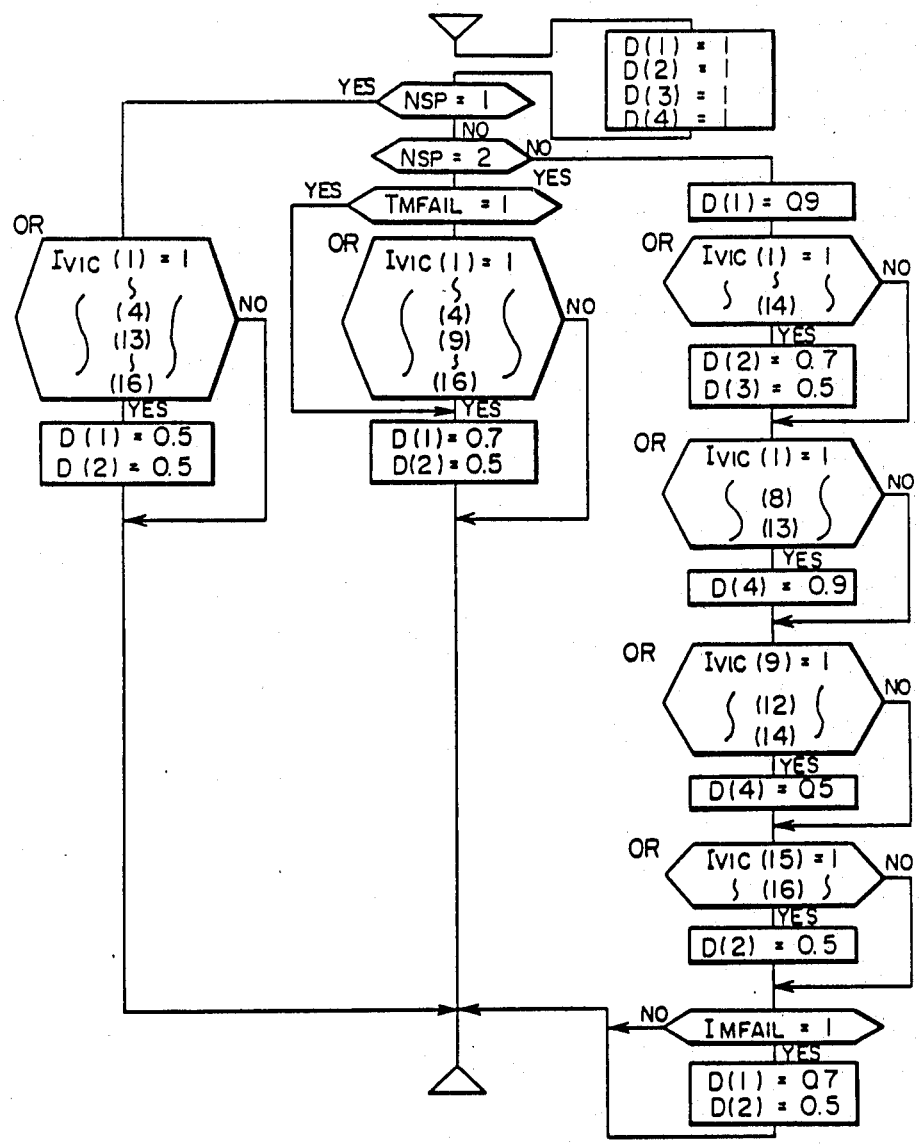
Figure 10:
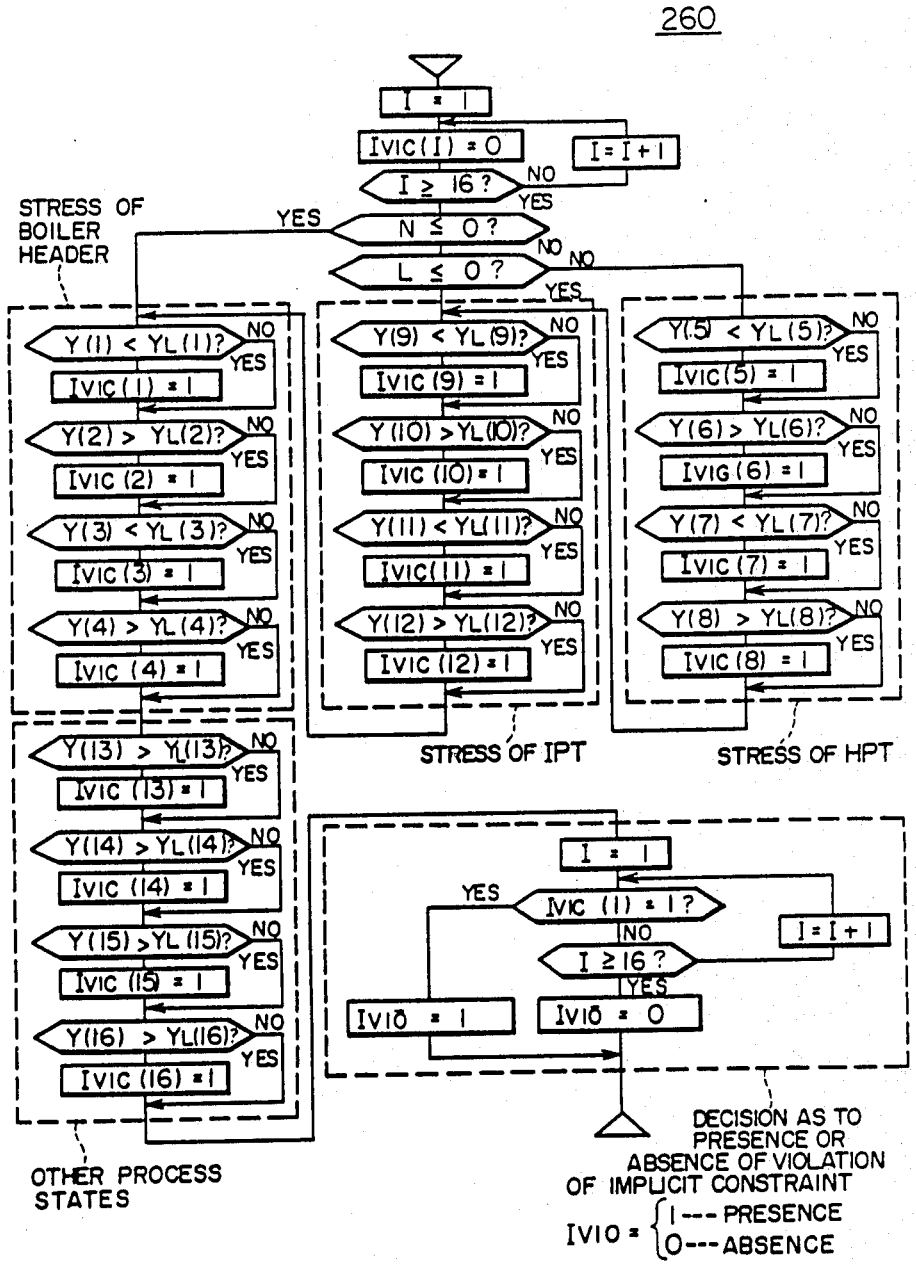

In the case where the operation parameters have been altered, sensitivity to the operation limiting factors becomes different and may assume a high, medium, low, or zero level, as illustrated in FIG. 8. Accordingly, it is believed that correction of the prolongation factor of the trial point in dependence on which operation limiting factor violates the implicit constraint (refer to FIG. 5) will make the searching of the optimum value more effective than the standardized correction. FIG. 9 illustrates an algorithm for determining the prolongation factor correcting coefficient on the basis of a monitor algorithm for the implicit constraint (refer to FIG. 10) in accordance with the concept mentioned above. (3) Sequencing of characteristic evaluations 300

Figure 11A:
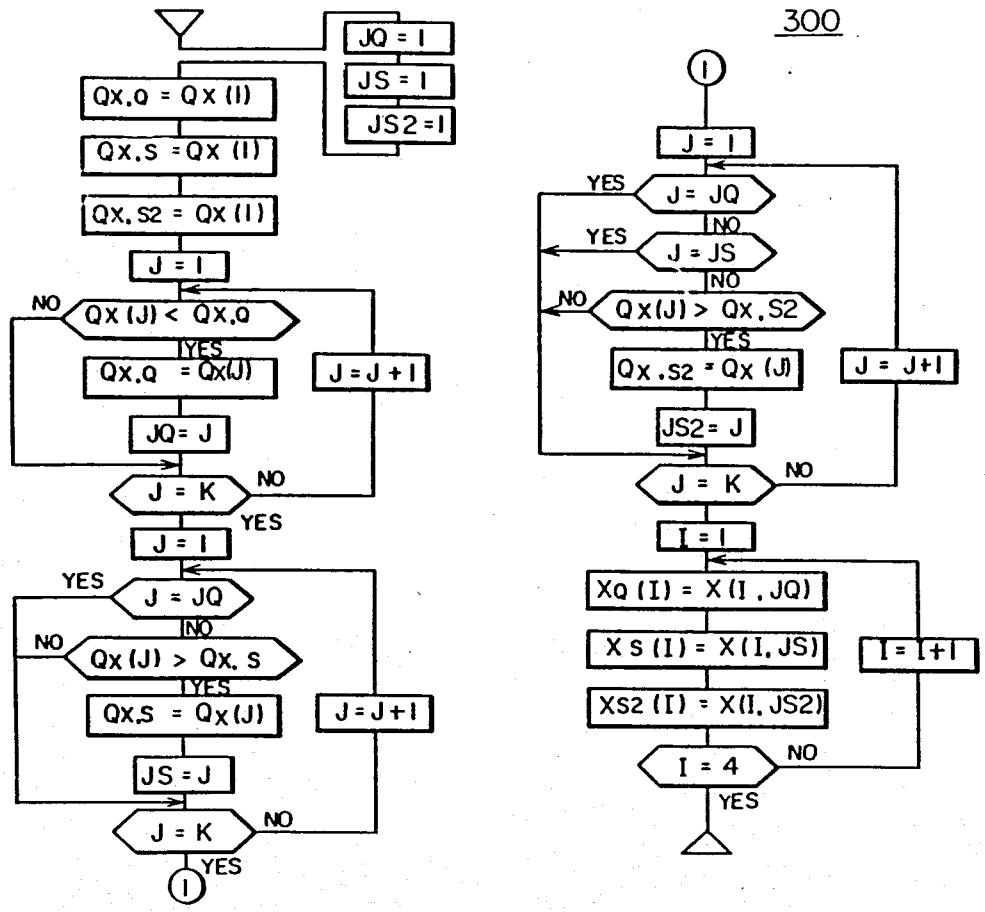
FIGS. 11A and 11B are flow charts illustrating a characteristic evaluating function.

This function resides in an algorithm for determining three characterizing points mentioned below from K apexes of the simplex (where K=8 in the case of the illustrated embodiment), as is illustrated in FIG. 11A (for the first and second embodiments) and FIG. 11B (for the third embodiment).

(i) Best apex ($X_Q$, $Q_{X,Q}$)

Figure 11B:
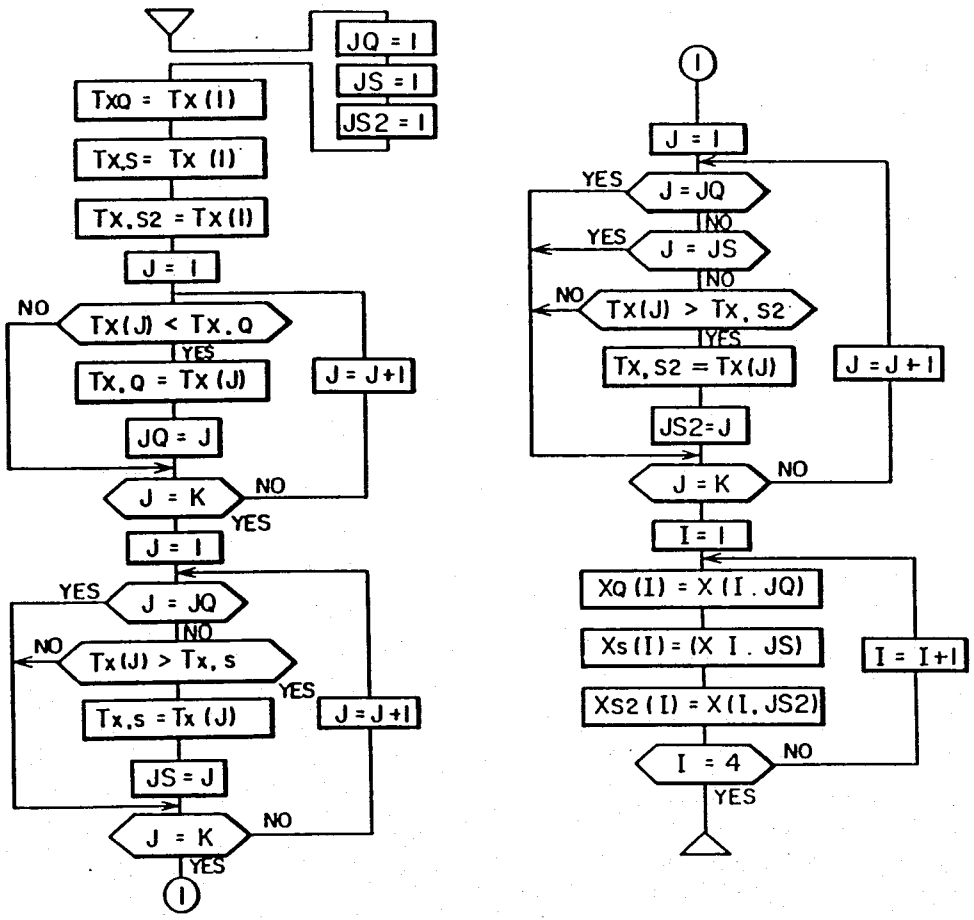

Operation parameter ($X_Q$) and the starting loss ($Q_{X,Q}$) in FIG. 11A or starting time ($T_{X,Q}$) in FIG. 11B which correspond to the apex associated with the minimum loss among K apexes.

(ii) Worst apex ($X_S$, $Q_{X,S}$)

Operation parameter ($X_S$) and the starting loss ($Q_{X,S}$) in FIG. 11A or starting time ($T_{X,S}$) in FIG. 11B which correspond to the apex associated with the maximum loss among K apexes.

(iii) Worst second apex ($X_{S2}$, $Q_{X,S2}$)

Operation parameter ($X_{S2}$) and the starting loss ($Q_{X,S2}$) in FIG. 11A or starting time ($T_{X,S2}$) in FIG. 11B which correspond to the apex associated with the greatest second starting loss among K apexes.

(4) Calculation of center of gravity 400

Figure 12:
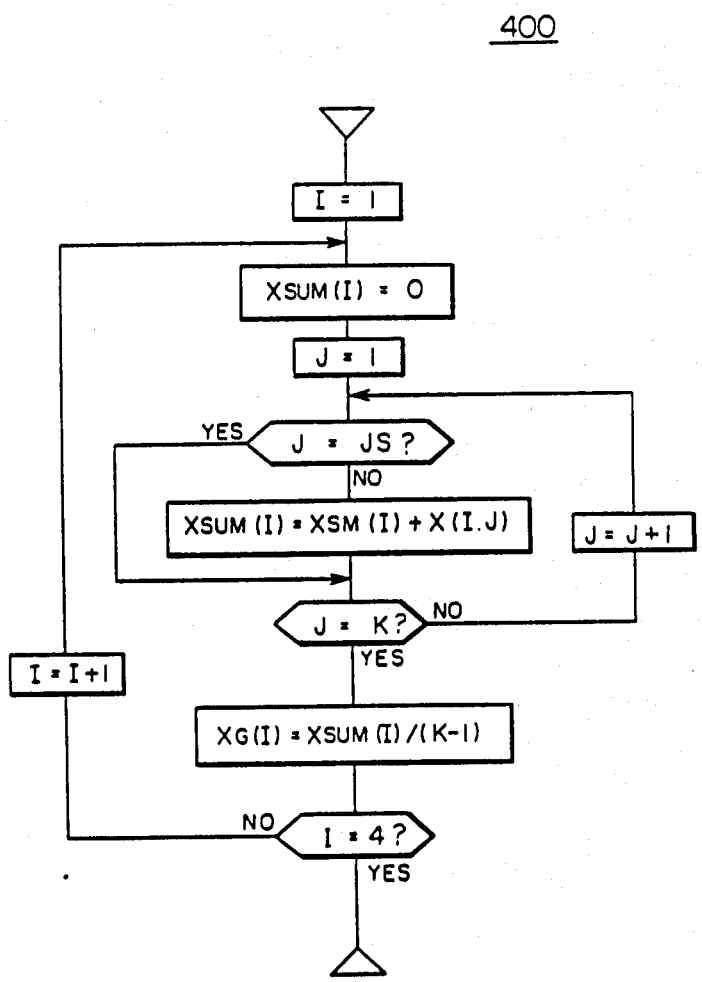
FIG. 12 is a flow chart illustrating a procedure for determining the center of gravity.

As will be seen in FIG. 12, coordinate $X_G$ of the geometrical center of gravity of the simplex includes (K-1) apexes exclusive of the worst apex $X_S$.

(5) Determination of new trial point 500

Figure 13:
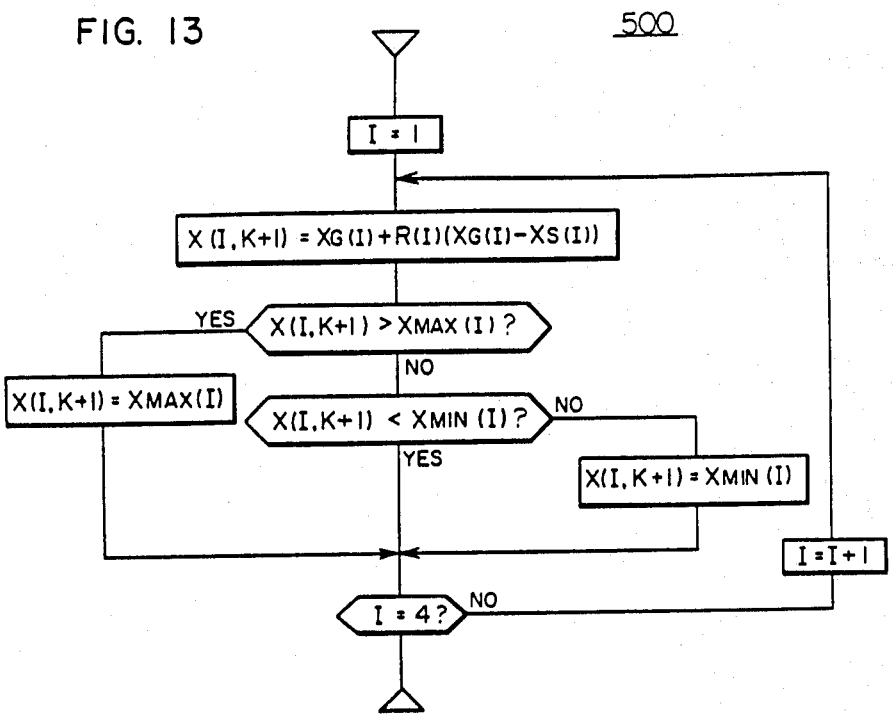
FIG. 13 is a flow chart illustrating a procedure for determining trial points.
Figure 14:
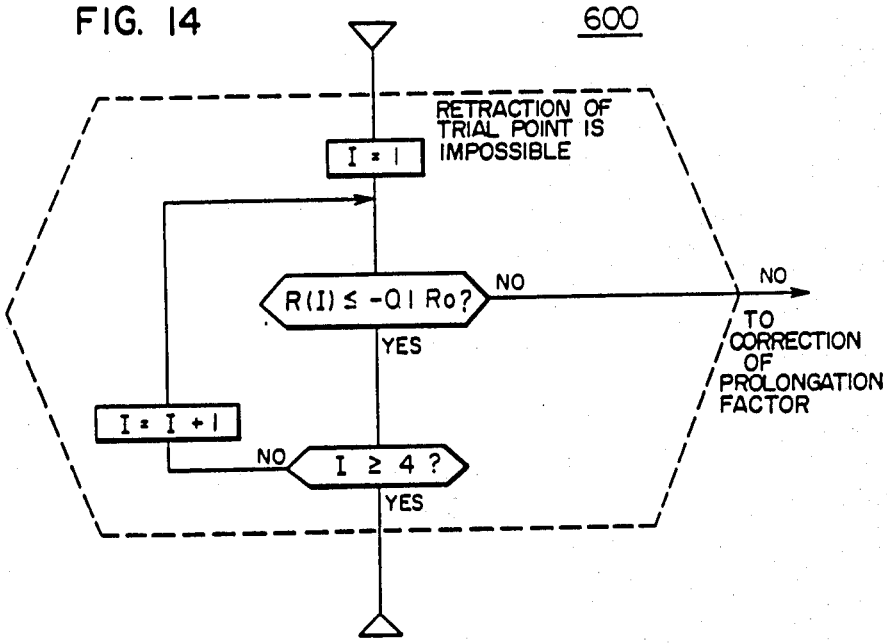
FIG. 14 is a flow chart illustrating a procedure for deciding whether retraction of the trial point is possible or not.

As is illustrated in FIG. 13, the coordinate which satisfies the expression (6) mentioned below is defined on the assumption that the new trial point is given by $X_{K+1}$. This point lies on a straight line interconnecting the worst apex and the center of gravity $X_G$ with a distance of $R(X_G-X_S)$ from the center of gravity, where R represents the prolongation factor described in paragraph (7).

$$X_{K+1} = X_G + R(X_G - X_S) \quad (6)$$

where $X_{MIN} \leq X_{K+1} \leq X_{MAX}$.

(6) Decision for impossibility of retraction of trial point 600

When the prolongation factor is corrected, the succeeding trial point tends to be retracted toward the center of gravity. However, such retraction is not allowed indefinitely but inhibited when $R \leq -0.1\ R_0$, and the simplex is reduced or degenerated as a whole to find out a new searching direction. This reduction or degeneracy method will be described in the paragraph (9).

(7) Correction of prolongation factor 700

Figure 15:
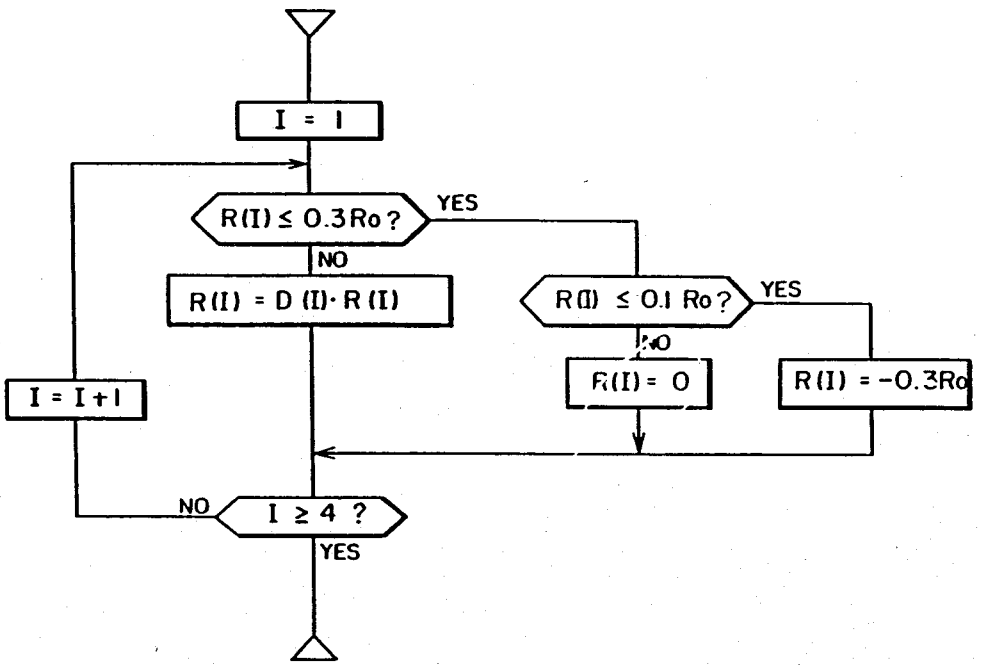
FIG. 15 is a flow chart illustrating a procedure for correcting a prolongation factor.
Figure 16:
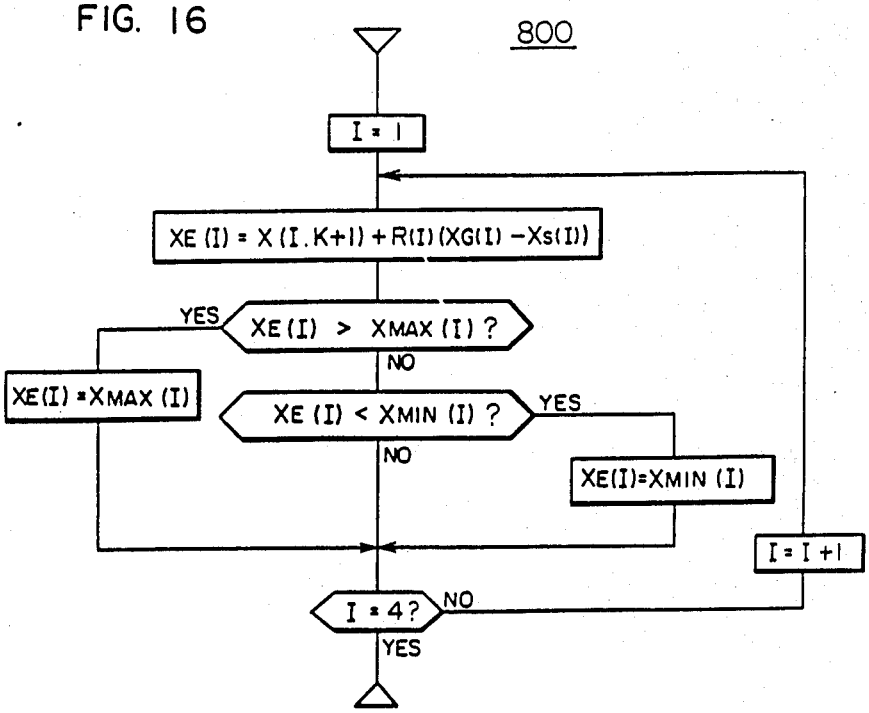
FIG. 16 is a flow chart illustrating a procedure for deciding whether a new trial point can be prolongated.
Figure 17:
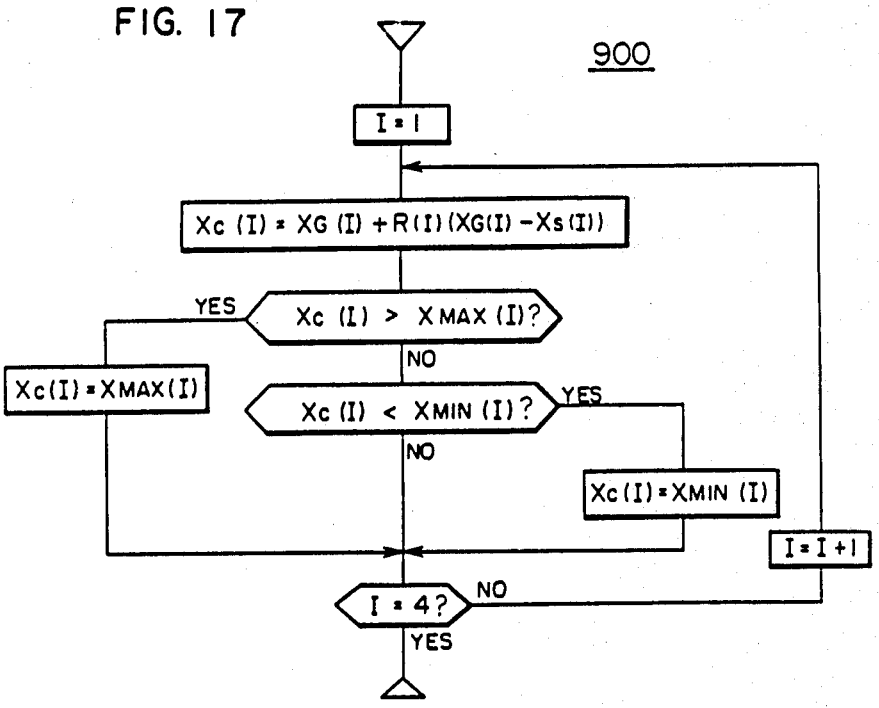
FIG. 17 is a flow chart illustrating a procedure for retracting a trial point.

When the implicit constraints are violated, the factor of prolongation R is corrected in accordance with a method illustrated in FIG. 15.

(8) Prolongation of new trial point 800

When the starting loss $Q_{X,K+1}$ or starting time $T_{X,K+1}$ at the new trial point $X_{K+1}$ is smaller than the minimum loss $Q_{X,Q}$ or $T_{X,Q}$ attained until then, prolongation is further made in the same direction with a view to approaching to the optimal point. The point attained by this prolongation is represented by $X_E$.

(9) Retraction of trial point 900

When the starting loss $Q_{X,K+1}$ or the starting time $T_{X,K+1}$ at the new trial point $X_{K+1}$ is greater than the greatest second loss $Q_{X,S2}$ or $T_{X,S2}$ encountered until then, there is a possibility that the new trial point $X_{K+1}$ might jump over the optimal point. Accordingly, when $Q_{X,K+1} \leq Q_{X,S}$ or when $T_{X,K+1} \leq T_{X,S}$, the trial point is retracted to an intermediate point toward the center of gravity (so that R=0.5R), while in the case where $Q_{X,K+1} < Q_{X,S}$ or $T_{X,K+1} > T_{X,S}$, greater retraction is made (so that R becomes equal to 0.5), as is illustrated in FIG. 7. The trial point thus attained is represented by $X_C$.

(10) Reduction of simplex 1300

Figure 18:
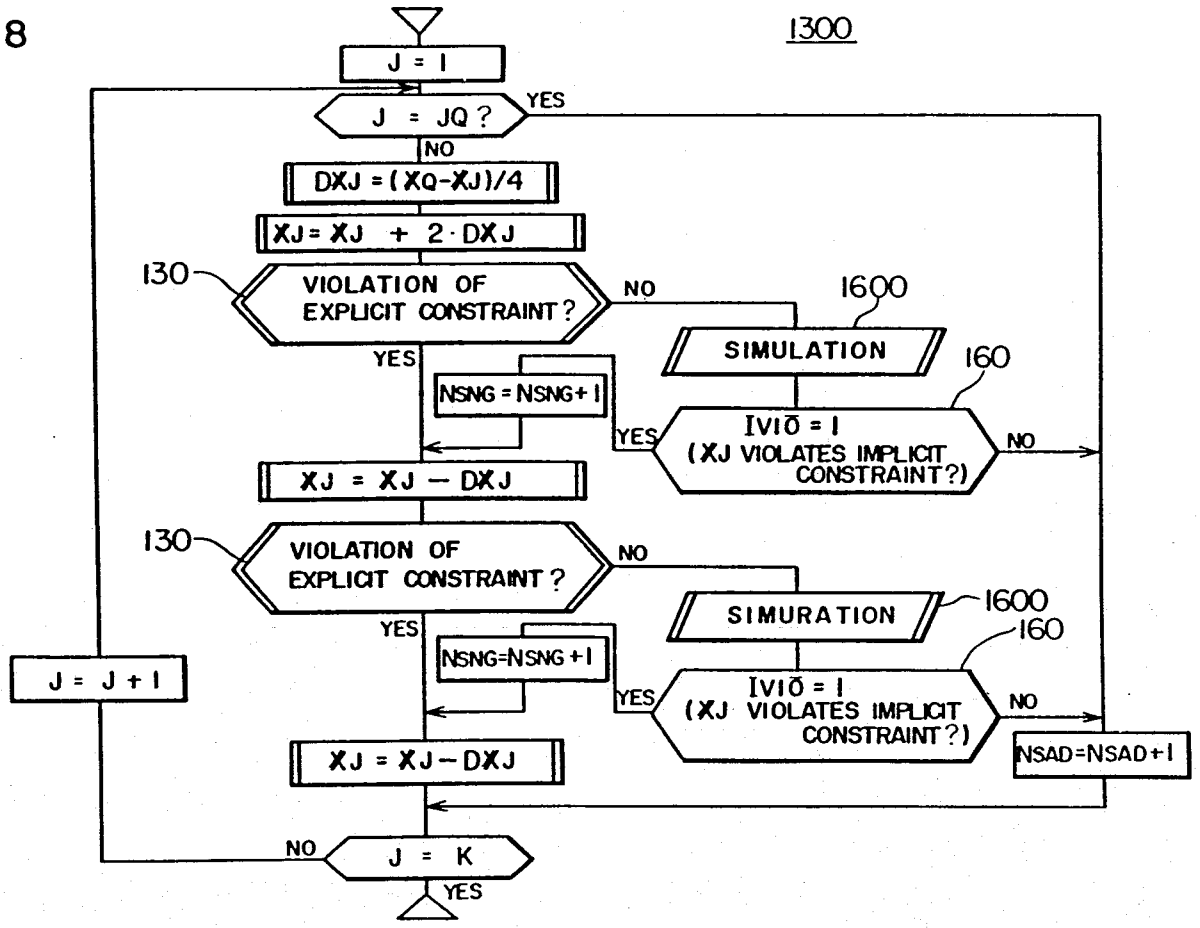
FIGS. 18 and 19 are flow charts illustrating reduction (degeneracy) of the simplex.
Figure 19:
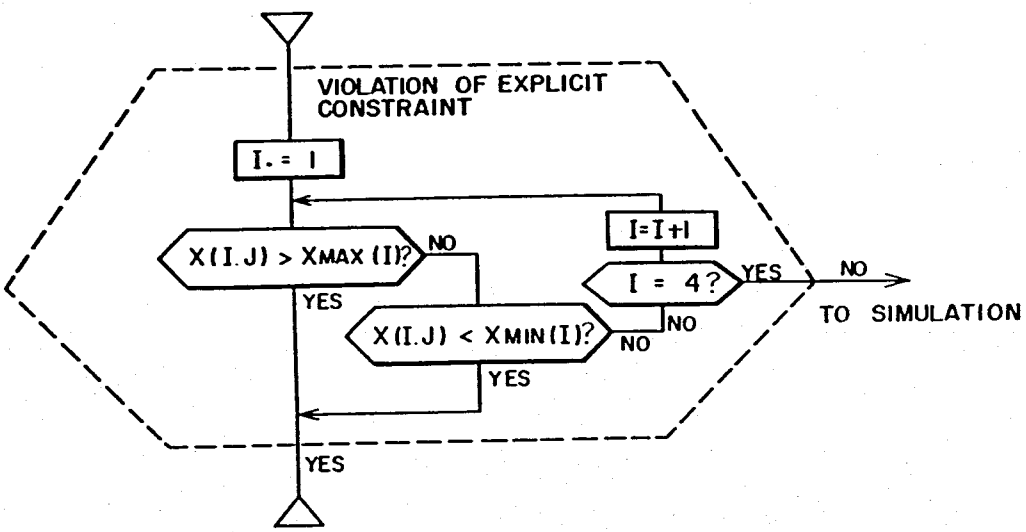

When no characteristic improving point can be found on a straight line interconnecting the worst point $X_S$ and the center of gravity $X_G$ (i.e. when $Q_{X,C} < Q_{X,S}$ or when $T_{X,C} < T_{X,S}$), the magnitude of the simplex is reduced in the direction toward the best point $X_Q$ for the purpose of again finding again the possibility of approaching to the optimal point. In that case, the factor of reduction is first selected to be ½, as is illustrated in FIG. 18. However, when every apex violates explicit constraints, the factor of reduction is set to ¾. These apexes which nevertheless violate the explicit constraints are returned to the original positions. The explicit constraints as used herein are defined to be the upper and lower limit values of the optimizing parameters themselves and are represented by $X_{MAX}$ and $X_{MIN}$, respectively. As is shown in FIG. 19, simulation is executed after it has been confirmed that all the parameters satisfy the explicit constraints.

(11) Exclusion of worst point 1420, 1440 and 1460

Figure 20A:
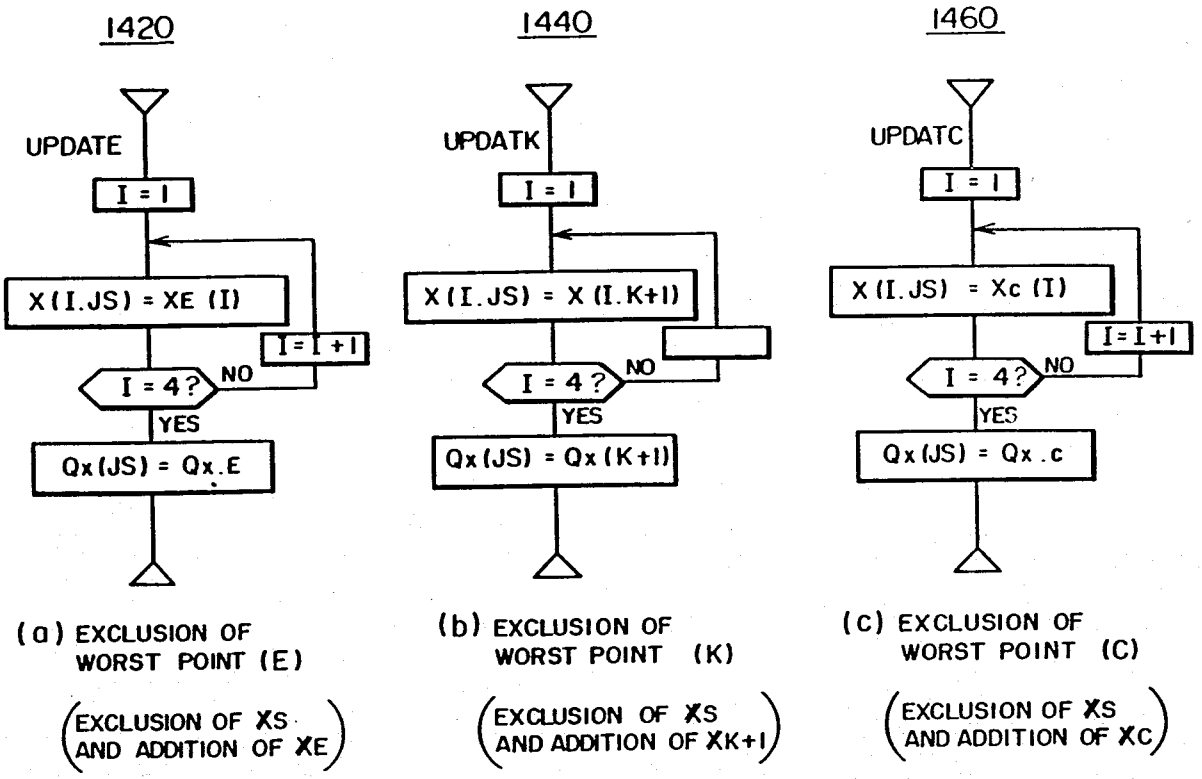
FIGS. 20A and 20B are flow charts illustrating exclusion of the worst points.
Figure 20B:
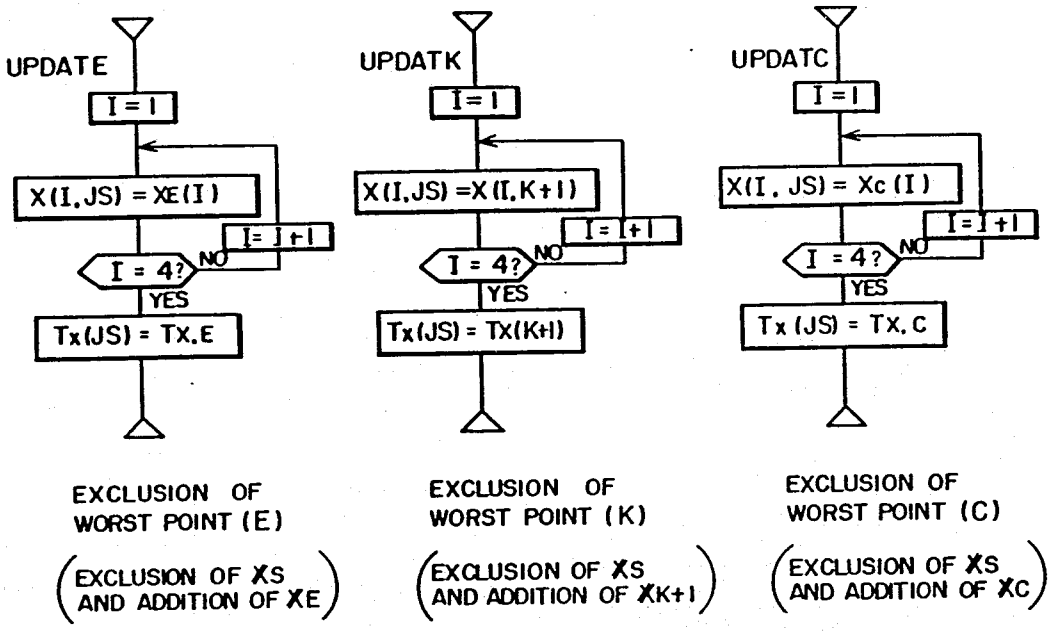

As is shown in FIG. 20, when the point $X_E$, $X_{K+1}$ or $X_C$ is improved as compared with the point $X_S$, the latter is excluded, while the point $X_E$, $X_{K+1}$ or $X_C$ is added to thereby create a new simplex.

(12) Decision if a limit number of searching times is attained 1500

Figure 21:
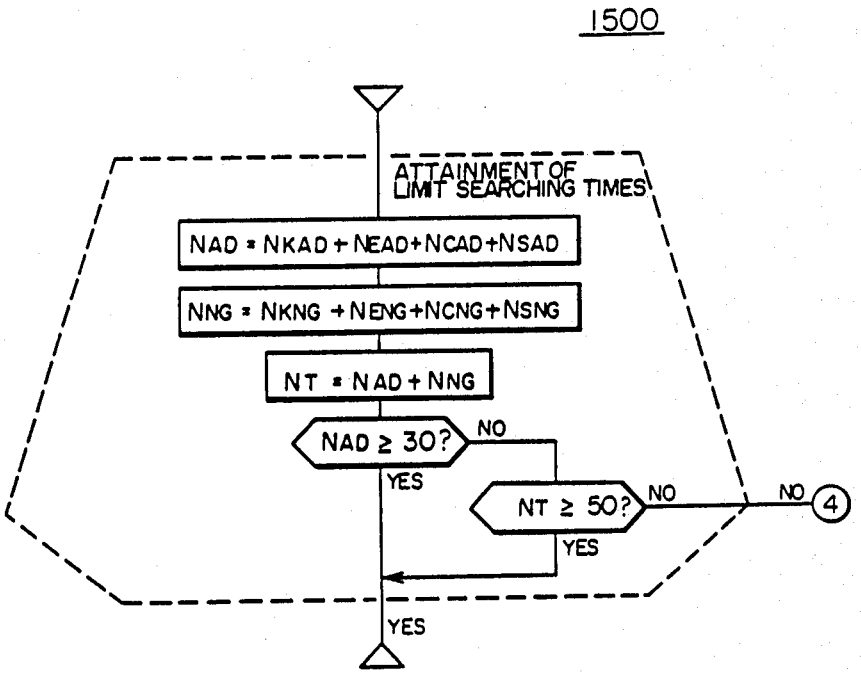
FIGS. 21 and 22 are flow charts illustrating the basic procedure for simulation.

The number of searching times corresponds to the number of times the simulation is executed. By limiting the number of searching times, the instant algorithm is protected from forming an endless loop. The processing procedure to this end is illustrated in FIG. 21 in which symbols as used have the meanings mentioned below:

$N_T$: Total number of times the simulation was executed, $N_{AD}$: The number of times the result of the simulation was used as the apex of the simplex, $N_{NG}$: The number of times the result of the simulation was not used as the apex of the simplex, $N_{KAD}$: The number of times the point $X_{K+1}$ was used as the apex of the simplex, $N_{EAD}$: The number of times the point $X_E$ was used as the apex of the simplex, $N_{CAD}$: The number of times the point $X_C$ was used as the apex of the simplex, $N_{SAD}$: The number of times the result of the simulation for the reduction of the simplex was used as the apex of the simplex, $N_{KNG}$: The number of times the point $X_{K+1}$ was not used as the apex of the simplex, $N_{ENG}$: The number of times the point $X_E$ was not used as the apex of the simplex, $N_{CNG}$: The number of times the point $X_C$ was not used as the apex of the simplex, and $N_{SNG}$: The number of times the result of the simulation for the reduction of the simplex was not used as the apex of simplex.

(13) Simulation 1600

Figure 22:
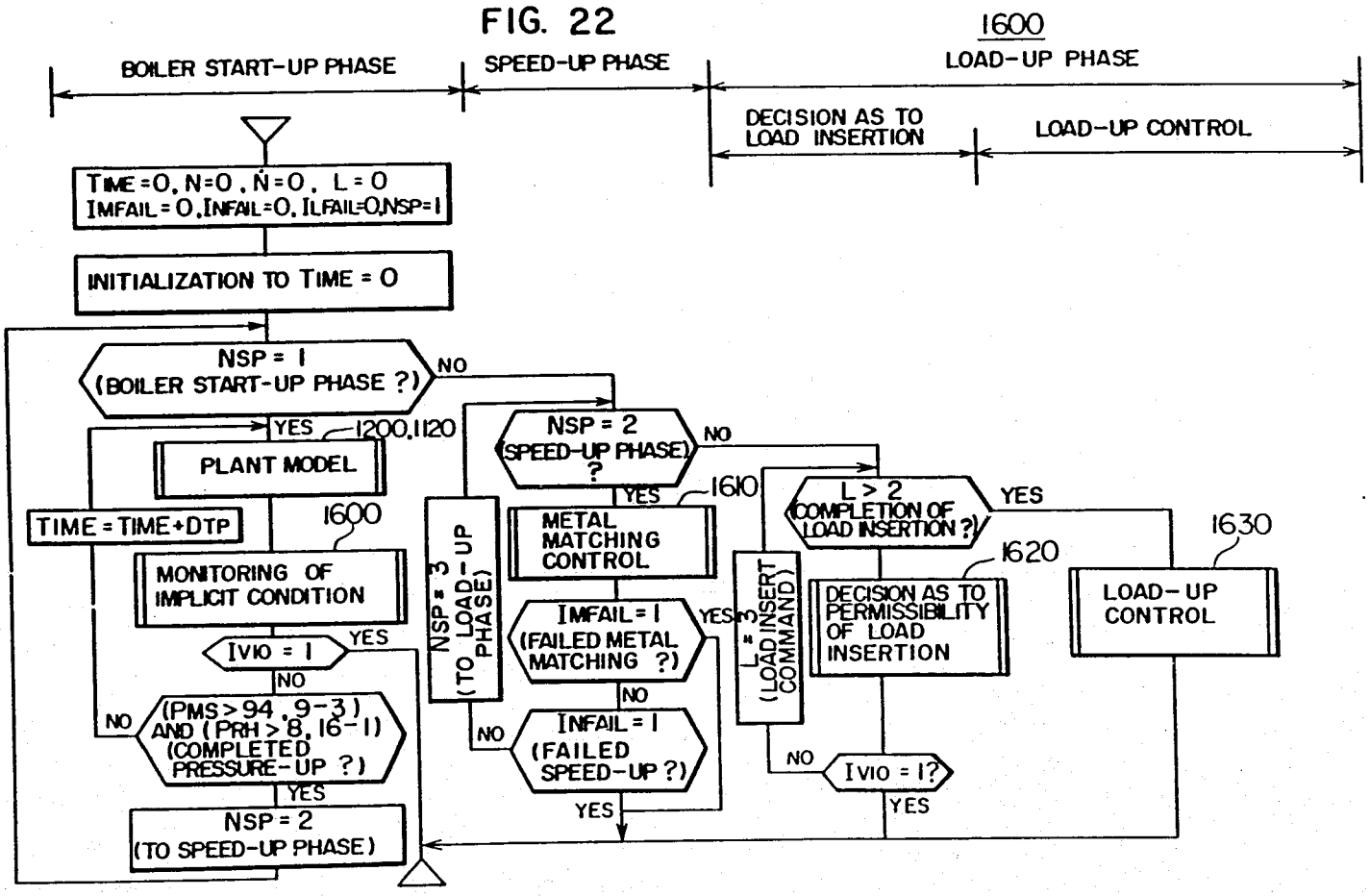

The basic procedure for simulation is illustrated in FIG. 22. In the simulation, the plant start-up process is divided into three phases, i.e. boiler start-up phase, speed-up phase and load-up phase. In the boiler start-up phase, a process routine from the ignition of the ignitors up to the pressure-up control (this function is incorporated in the dynamic plant model) is executed until the pressure values established for the start-up operation (the pressure of main steam is 94.9 ata. and that of reheated steam is 8.16 ata.) have been reached. In the speed-up phase, the speed is increased to the rated speed value through a metal matching function which includes a speed-up control function. This phase is continued until value through a metal matching function which includes a speed-up control function. This phase is continued until the metal matching condition imposed on the high pressure turbine (HPT) is satisfied. In the load-up phase, additional loads are inserted until the rate load level (the target load in the practical operation) has been attained through the load-up control function.

(14) Decision as to convergence to optimal point 1700

The optimal point, i.e. the start-up schedule which involves the minimum loss, is defined by $X_Q$ satisfying the following expression:

$$\frac{Q_{X,S} - Q_{X,Q}}{O_{X,Q}} < \epsilon \quad (7)$$

The point $X_Q$ satisfying the above condition will be represented by $X_{OPT}$.

In the foregoing, the off-line optimizing function 1110 has been described in detail. Next, description will be directed to the on-line optimizing function.

For achieving the quick start-up through on-line optimization, attention is paid to the matters mentioned below.

(1) Quick pressure-up by considering the rate of variation in temperature of the drum steam Increasing in the pressure (pressure-up) of the main steam means that of drum pressure which makes appearance as a corresponding increase in a saturated temperature determined by the drum pressure. Besides, when the temperature in drum steam varies, thermal stress is produced in the drum. For limiting the thermal stress produced in the drum to a level below the permissible value, it is required that the temperature variation rate of the steam be lowered below a permissible value. According to the present invention, such an arrangement is adopted in which the target pressure value is determined so that the maximum permissible rate of variation in temperature can be constantly assured, in view of the fact that the relation between the pressure and the saturated temperature is non-linear. With this arrangement, the time required for the pressure-up can be made minimum.

(2) Steam admission for speed-up based on calculated optimal metal matching condition The plant subjected to the control is of an intermediate pressure start-up type (i.e. the speed-up is performed by an intermediate pressure turbine or IPT). The metal matching conditions for both the high pressure turbine (HPT) and the intermediate pressure turbine (IPT) have to be taken into consideration. According to the teaching of the present invention, steam is admitted to the intermediate pressure turbine for the speed-up as soon as the temperature of the reheated steam has attained the steam admission level which is determined on the basis of the metal temperature of the intermediate pressure turbine. Upon completion of the speed-up phase, control for the load-up phase is initiated immediately when the temperature of the main steam has attained a steam admission level determined on the basis of the metal temperature of the high pressure turbine. Through this procedure, the stand-by time taken for awaiting the steam admission can be reduced to a necessary minimum.

(3) Quick speed-up in consideration of stress of the intermediate pressure turbine By determining successively the maximum speed-up rate while suppressing stress (including thermal stress and centrifugal stress) produced in the rotor surface portion and bore of the intermediate pressure turbine to a level lower than the permissible limit, the speed-up operation is completed within a short time.

(4) Early load throw-in by judging permissible conditions

The temperature of steam generated by the boiler rises up quickly immediately after the load throw-in. If the throw-in of the load is effected only for the purpose of satisfying the metal matching condition for the high pressure turbine without giving consideration to the phenomenon mentioned above, excessive thermal stress will be produced in the rotor of the high pressure turbine even when the load is held constant. Under this circumstance, in the case of the illustrated embodiments, stress which will be produced is predicted with the aid of a plant model. When the predicted load is lower than a permissible value, the insertion of the load is allowed, while satisfaction of the load insertion condition is awaited when the predicted load is higher than the permissible value. Through this procedure, the stand-by time for the throw-in of the load can be decreased to a minimum, which in turn means that the start-up time can be ultimately reduced.

(5) Quick load-up by considering the stress of high and intermediate pressure turbines Load insertion is effected within the shortest possible time by determining successively the maximum load-up rate while suppressing to a minimum the stress (including thermal stress and centrifugal stress) produced in the rotor surface portion and the bore of the high and intermediate pressure turbines.

A description will now be given in detail on the on-line optimizing function 1120 prepared on the basis of the basic concept described above.

(1) Pressure-up control

Figure 23:
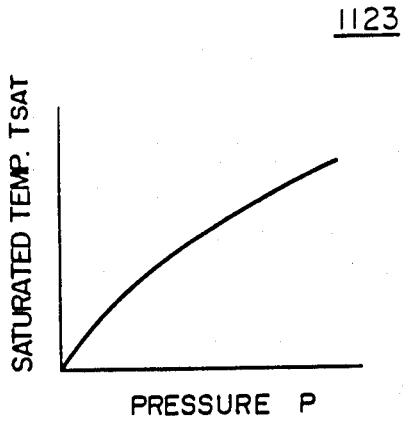
FIG. 23 is a graph illustrating a relation between pressure and saturated temperature.

Upon starting the plant, thermal stress is produced in the boiler drum due to variation in temperature of the internal fluid. In order to prevent excessively great thermal stress from occurring at that time, it is necessary to suppress the rate of variation in the temperature of the internal fluid to a value not exceeding the permissible value. Since the internal fluid temperature can be regarded as the saturated temperature determined definitely by the pressure prevailing at that time point, the permissible rate of temperature variation may be expressed in terms of the permissible rate of pressure variation. As is illustrated in FIG. 23, the relationship 1123 between the pressure P and the saturated temperature $T_{SAT}$ is non-linear. Assuming now that a set $\alpha(P)$ of the rates of change in the saturated temperature at a pressure P is expressed as follows:

$$\alpha(P) = \left(\frac{dT_{SAT}}{dt}\right)_P \quad (8)$$

and that the permissible value of the variation rate of the saturated temperature is represented by $\alpha_L$, the permissible rate $\beta(P)$ 1124 of pressure variation at the pressure P may be given by $$\beta(P) = \mathrm{Max}\left\{\frac{dP}{dt}\,\alpha(P) < \alpha_L\right\}. \quad (9)$$

Figure 24:
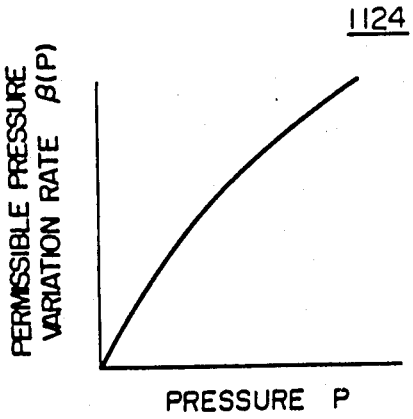
FIG. 24 is a graph illustrating a relation between pressure and pressure variation rate (rate of change of pressure)
Figure 25:
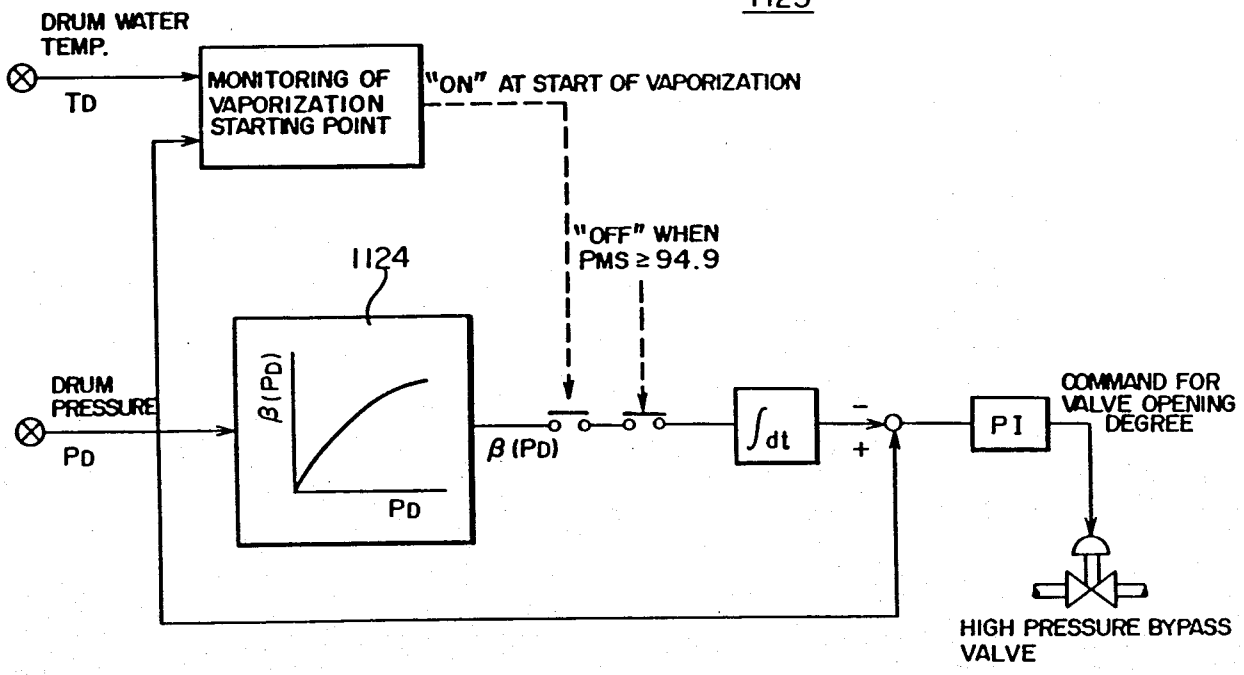
FIG. 25 is a schematic block diagram illustrating a pressure-up control technique.

Thus, there can be obtained a characteristic curve illustrated in FIG. 24. This characteristic curve shows that the permissible rate of pressure variation assumes a greater value as the pressure level becomes higher. The pressure-up control system implemented by taking advantage of this characteristic is illustrated in FIG. 25 in a block diagram.

(2) Metal matching control 1610

Figure 26:
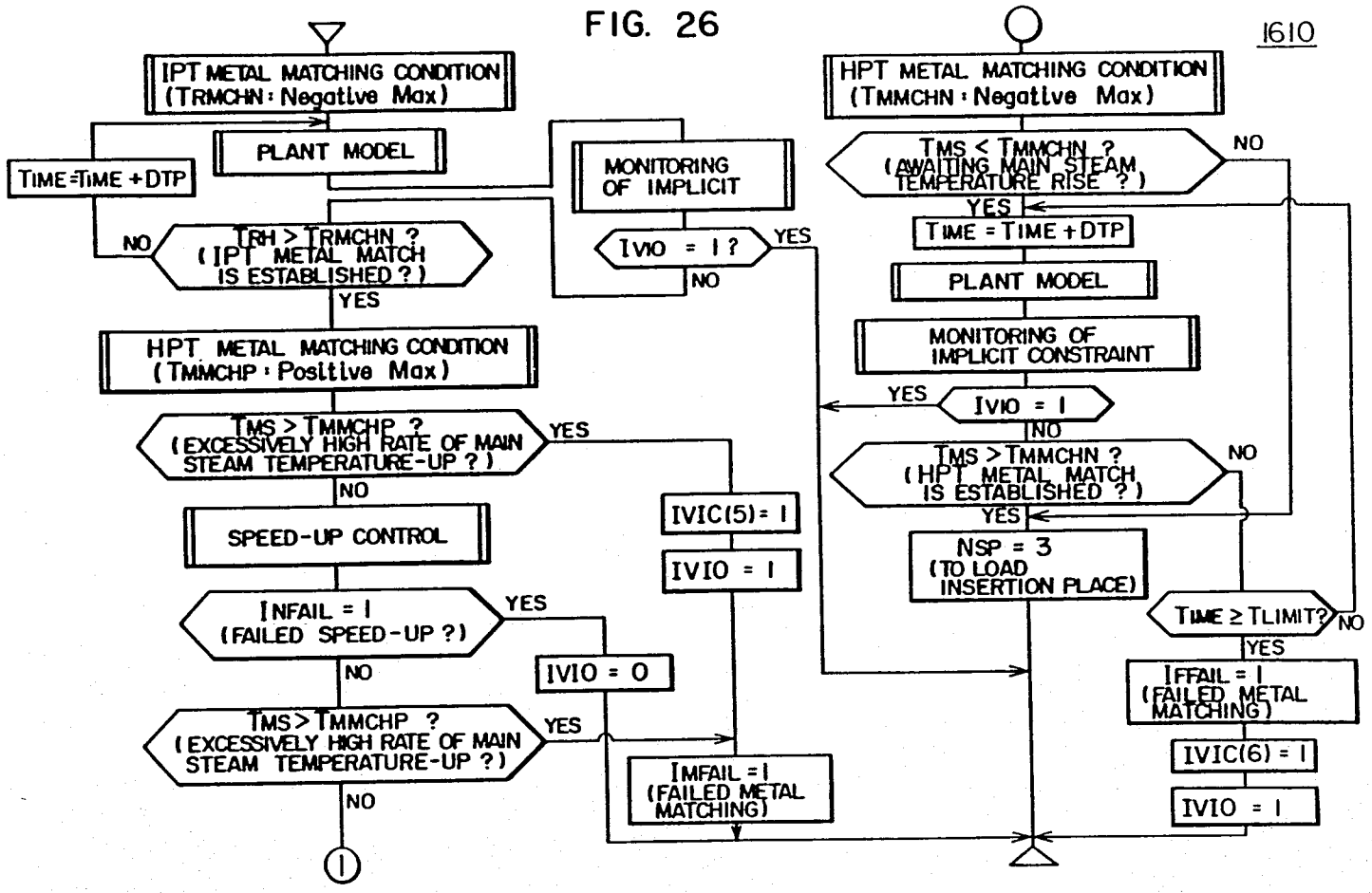
FIG. 26 is a flow chart illustrating a basic processing procedure.

A basic processing procedure for the metal matching control is illustrated in FIG. 26. Since the plant under consideration is assumed to be of the type in which the start-up is initiated starting from the intermediate pressure turbine, the metal matching condition is regarded to be satisfied to permit the start-up of the intermediate pressure turbine when the temperature of reheated steam $T_{RH}$ exceeds a value $T_{RMCHN}$ (the value representing the lower limit temperature satisfying the metal matching condition of the intermediate pressure turbine in terms of the temperature of reheated steam and hereinafter referred to as the Negative Max temperature for the intermediate pressure turbine). On the other hand, when the reheated steam temperature $T_{RH}$ is lower than the value $T_{RMCHN}$, the temperature rise is awaited in the current state. However, when the main steam temperature $T_{MS}$ at the time point at which the metal matching condition is satisfied is higher than a value $T_{MMCH}$ (the value representing the upper limit temperature satisfying the metal matching condition of the high pressure turbine in terms of the main steam temperature and hereinafter referred to as the Positive Max temperature for the high pressure turbine), then this means that the temperature rise of the main steam takes place too quickly. Consequently, the load-up through steam admission to the high pressure turbine is impossible, which in turn means that the speed-up of the intermediate pressure turbine is no more meaningful. In other words, the metal matching results in failure. Further, the metal matching is regarded to be failed when it occurs that $T_{MS}$'$T_{MMCHP}$ in the course of the speed-up process. When the main steam temperature $T_{MS}$ after completion of the speed-up process is lower than a temperature value $T_{MMCHN}$ (a value representing the lower limit temperature satisfying the metal matching of the high pressure turbine in terms of the main steam temperature and hereinafter referred to as Negative Max value or temperature for the high pressure turbine), temperature-up of the main steam is effectuated. Subsequently, when the metal matching condition is satisfied with $T_{MS} > T_{MMCHN}$, the processing is transferred, to the function of examining the condition for permitting the parallel activation of the load-up phase. There may arise such a situation in which the state awaiting the metal matching condition being satisfied continues indefinitely after the completed speed-up process. To avoid such situation, a limit ($T_{LIMIT}$) is imposed on the time taken for the simulation, whereby the start-up operation is regarded as failed when the time limit mentioned above has been attained. By virtue of this feature, the time for calculation in the simulation can be reduced.

Next the procedure for calculating the metal matching condition mentioned above will be described in detail.

(i) Negative Max value ($T_{RMCHN}$) for the intermediate pressure turbine 1611

Figure 27:
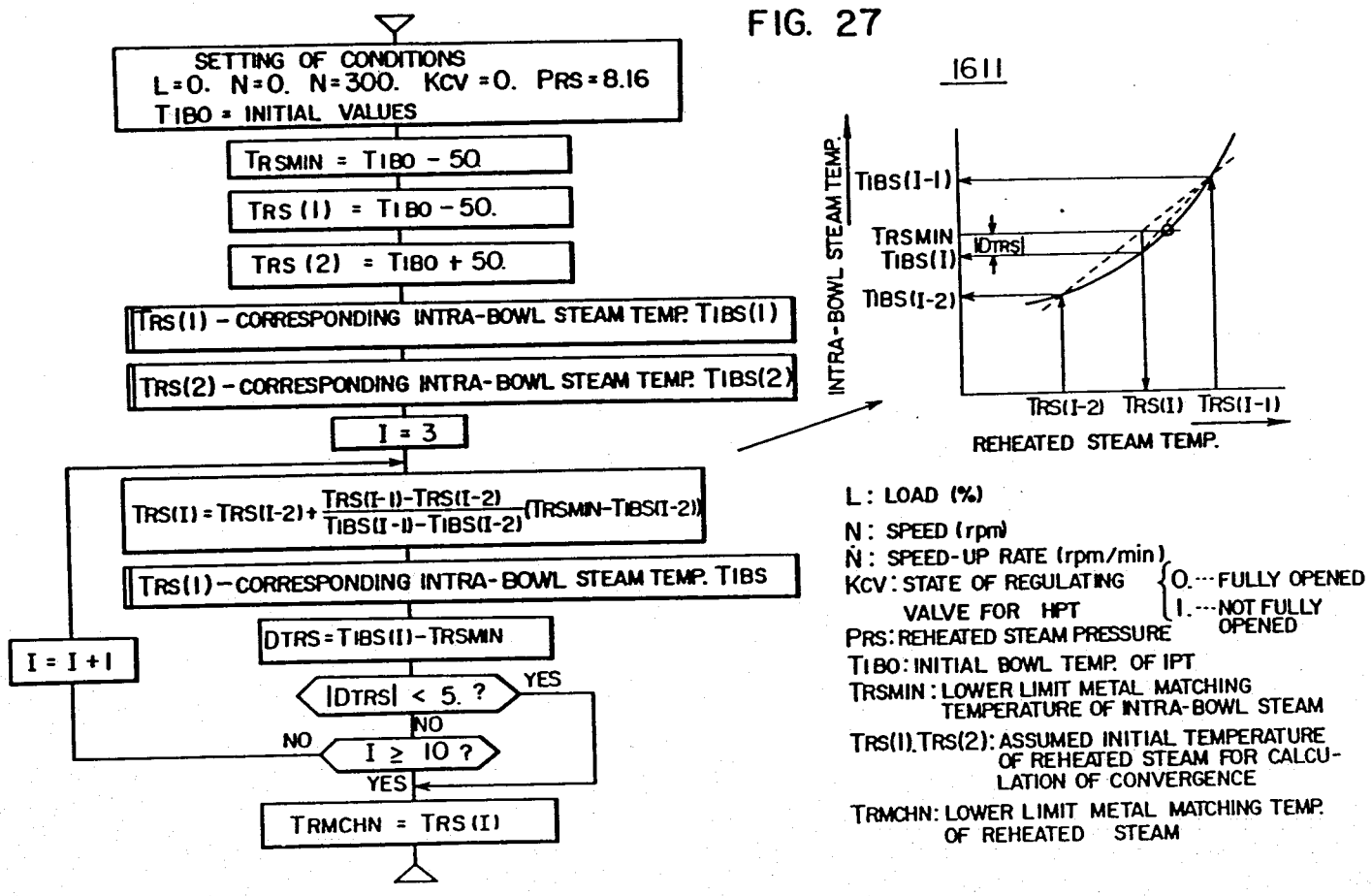
FIG. 27 contains a flow chart and a graph illustrating a procedure for determining arithmetically a metal matching lower limit temperature ($T_{RMCHN}$) of reheated steam.

FIG. 27 shows a procedure for arithmetically determining the Negative Max temperature value ($T_{RMCHN}$) of the reheated steam for the intermediate pressure turbine. In the case of the illustrated embodiments, the metal matching lower limit $T_{RMSIN}$ of the temperature of the steam within a bowl of the intermediate pressure turbine supplied with steam is set at a value lower than the bowl temperature $T_{IBO}$ by 50° C. The processing illustrated in FIG. 27 is to calculate the reheated steam temperature $T_{RH}$ so that the intra-bowl steam temperature may be equal to the temperature value $T_{RSMIN}$. In executing the instant processing, the calculation routine (for determining the intra-bowl steam temperature from the reheated steam temperature) is used in common for determining reversely the temperature $T_{RMCHN}$ from the temperature $T_{RSMIN}$ by resorting to a convergence method.

(ii) Positive Max value ($T_{MMCHP}$) for high pressure turbine 1612

Figure 28:
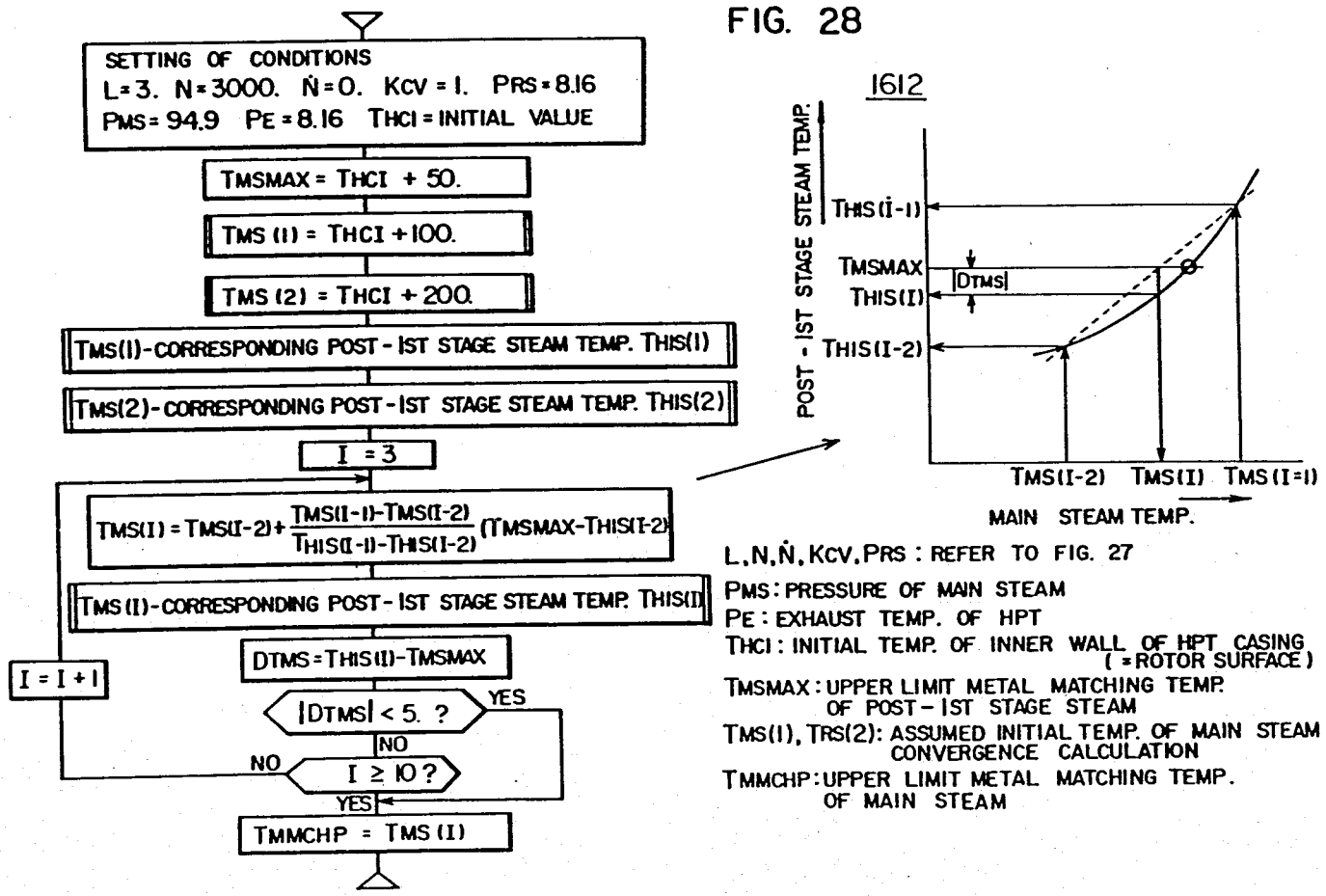
FIG. 28 is contains a flow chart and a graph illustrating a procedure for determining arithmetically a metal matching upper limit temperature ($T_{MMCHP}$) of main steam.

FIG. 28 shows a procedure for calculating the Positive Max temperature value ($T_{MMCHP}$) of the main steam for the high pressure turbine. In the case of the illustrated embodiment, the metal matching upper limit temperature $T_{MSMAX}$ of the steam having passed through the first stage of the high pressure turbine supplied with steam is set at a value higher than the rotor surface temperature (which may be regarded to be equal to the inner wall temperature of the casing) by 50° C. The processing illustrated in FIG. 28 is to arithmetically determine the main steam temperature $T_{MMCHP}$ at which the post-1st-stage temperature of the steam having passed through the first stage becomes equal to the temperature $T_{MSMAX}$. In executing the instant processing, a calculation routine (for determining the post-1st-stage temperature from the main steam temperature) included in the turbine stress calculating function 1230 is used in common to thereby determine reversely the temperature $T_{MMCHP}$ from the metal matching upper limit temperature $T_{MSMAX}$, similar to the case described above in the preceding section i).

(iii) Negative Max value ($T_{MMCHN}$) for, high pressure turbine 1613

Figure 29:
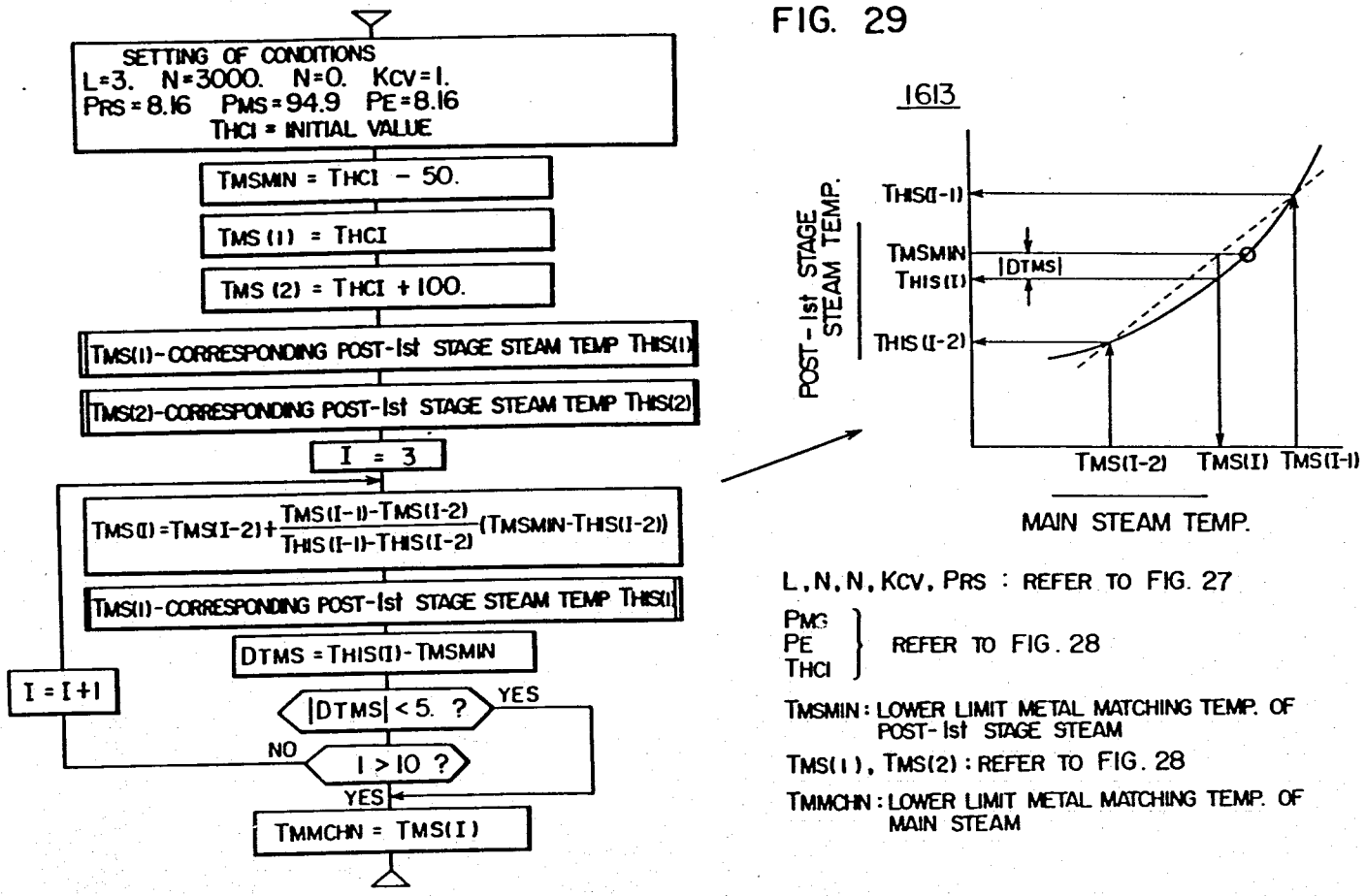
FIG. 29 is contains a flow chart and a graph illustrating a procedure for determining arithmetically a metal matching lower limit temperature ($T_{MMCHN}$) of main steam.
Figure 30:
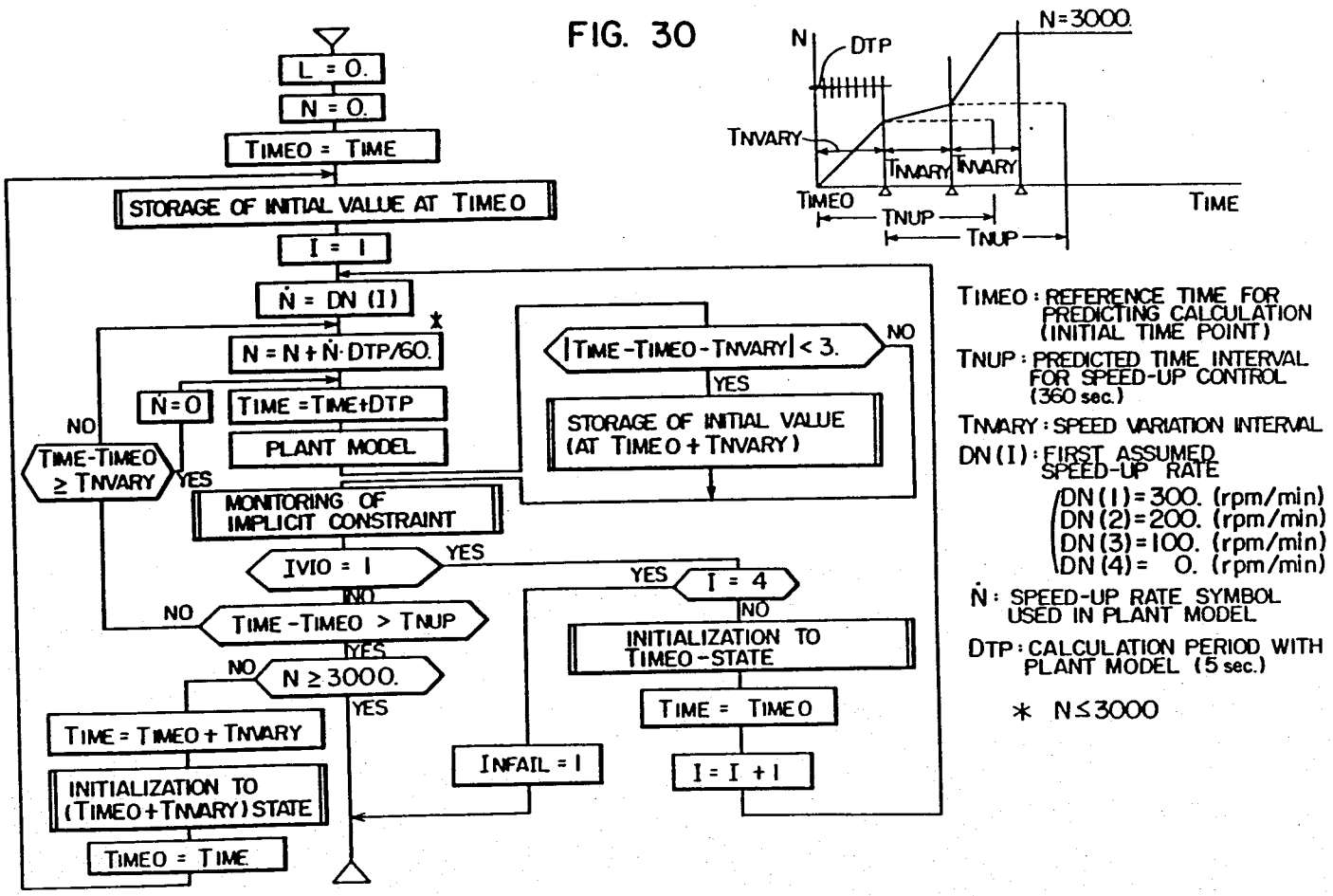
FIG. 30 is contains a flow chart and a graph illustrating a procedure for speed-up control.

FIG. 29 shows a procedure for arithmetically determining the Negative Max value ($T_{MMCHN}$) of the main steam for the high pressure turbine. The same procedure as the one described in the preceding section (ii) is employed for determining the main steam temperature $T_{MMCHN}$ corresponding to the FIG. 30 shows a processing procedure for executing speed-up control. This processing is characterized in that:

(i) Stress produced in the intermediate pressure turbine is predicted, wherein by determining stepwise the maximum speed-up rate at which the predicted value is lower than the permissible value, the turbine is started in accordance with a speed-up pattern which allows the speed-up time to be the shortest; and (ii) The plant model can be used as it is for the prediction for enhancing the accuracy of the stress prediction.

According to the instant procedure, assuming that speed-up is performed with a maximum speed-up rate DN(1) during a period $T_{NVARY}$ starting from a reference time point $T_{IMEO}$, being followed by holding constant the speed at the attained level, prediction is made for the stress which will be produced during a period of $T_{IMEO}+T_{NVP}$. When the result of the prediction shows that the predicted value of stress is smaller than the permissible value at any point, the speed-up is actually carried out (as a part of the start-up simulation) at the speed-up rate DN(1) from the time point $T_{IMEO}$ to $T_{NVARY}$. To the contrary, when the predicted value goes beyond the permissible value, a speed-up rate DN(2) of the next lower rank is set to the model, and the prediction of stress possibly produced is made. If the predicted value of stress exceeds the permissible value even with the speed-up rate of the third lower rank DN(3), the speed-up rate of the fourth lower rank DN(4) is set and the speed is held. Upon lapse of the period $T_{NVARY}$ from the reference time point $T_{IMEO}$, the reference time point $T_{IMEO}$ is again set, to thereby repeat the similar processing. When the rated speed has been attained as the result of repetition of the processing described above, the speed-up control comes to an end, whereupon the control is transferred to the processing for determining the condition which permits the throw-in of the load.

(4) Decision as to the condition permitting throw-in of the load 1620

Figure 31:
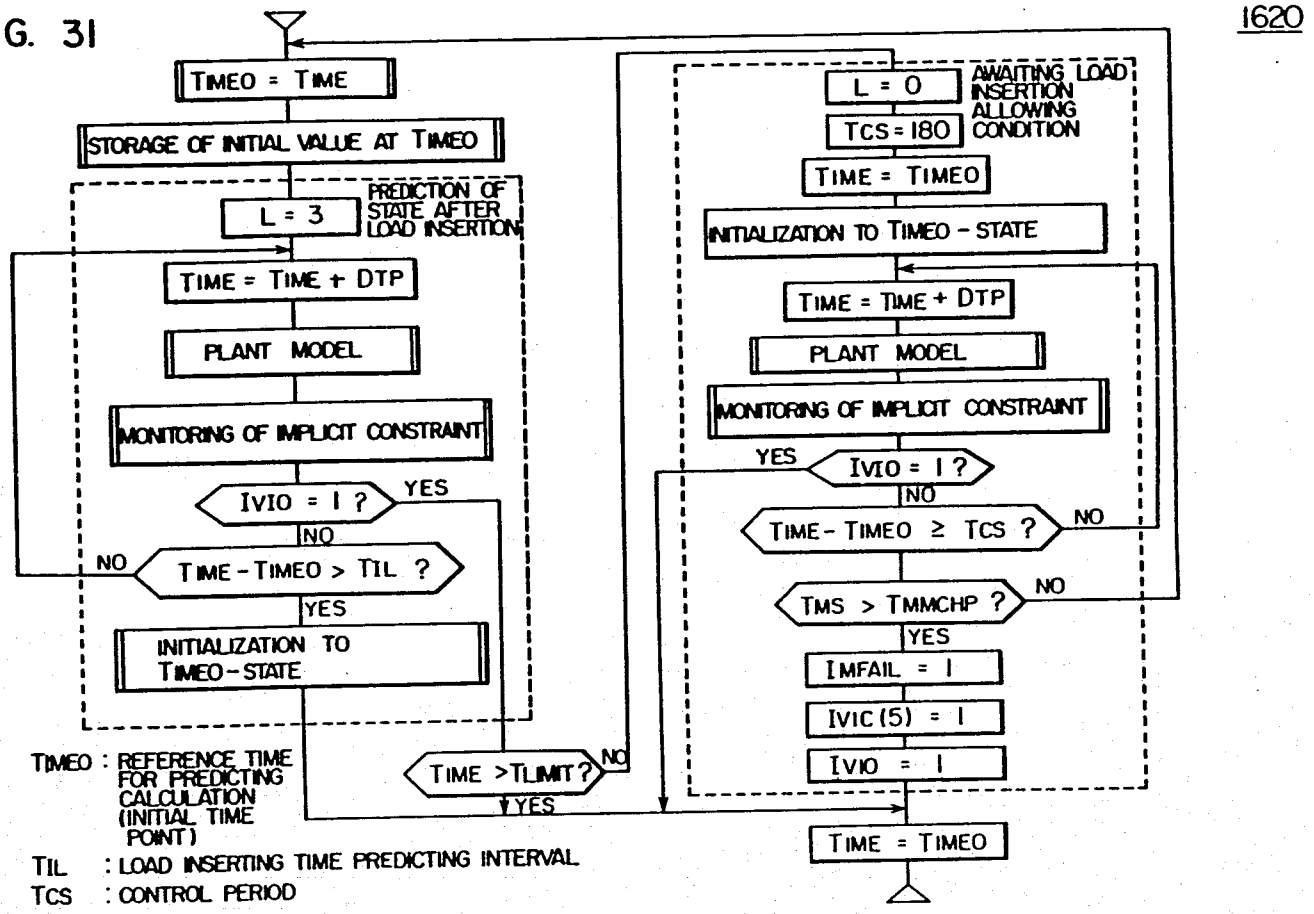
FIG. 31 is a flow chart illustrating a procedure for deciding the conditions which allow insertion (throw-in) of load.

FIG. 31 shows a processing procedure for deciding whether the condition which permits the connection of the load is met or not. As indicated by the broken lines, this processing procedure can be by and large divided into two parts described below.

(i) Prediction of state after throw-in of load

After the throw-in of the initial load (L=3%), stress as possibly produced is predicted with the aid of the plant model, and a decision is made as to whether the stress as predicted is below a permissible value throughout the whole period of prediction $T_{IL}$. When the predicted stress is within the permissible range, additional load can be inserted.

(ii) Stand-by till satisfaction of condition for throw-in of load

When the result of the prediction mentioned above is negative (i.e. when the predicted stress is beyond the permissible value), the throw-in of load is not carried out but the no-load operation is continued until the next prediction is performed. When the main steam temperature $T_{MS}$ exceeds in the meantime the upper limit temperature $T_{MMCHP}$ for the metal matching condition of the high pressure turbine, this means failure in the metal matching and hence failure of the start-up. Unless the metal matching is failed, the processing procedure described in the preceding paragraph (i) is regained to perform prediction on the state which will prevail when the load is thrown in.

(5) Load-up control-step 1630

Figure 32:
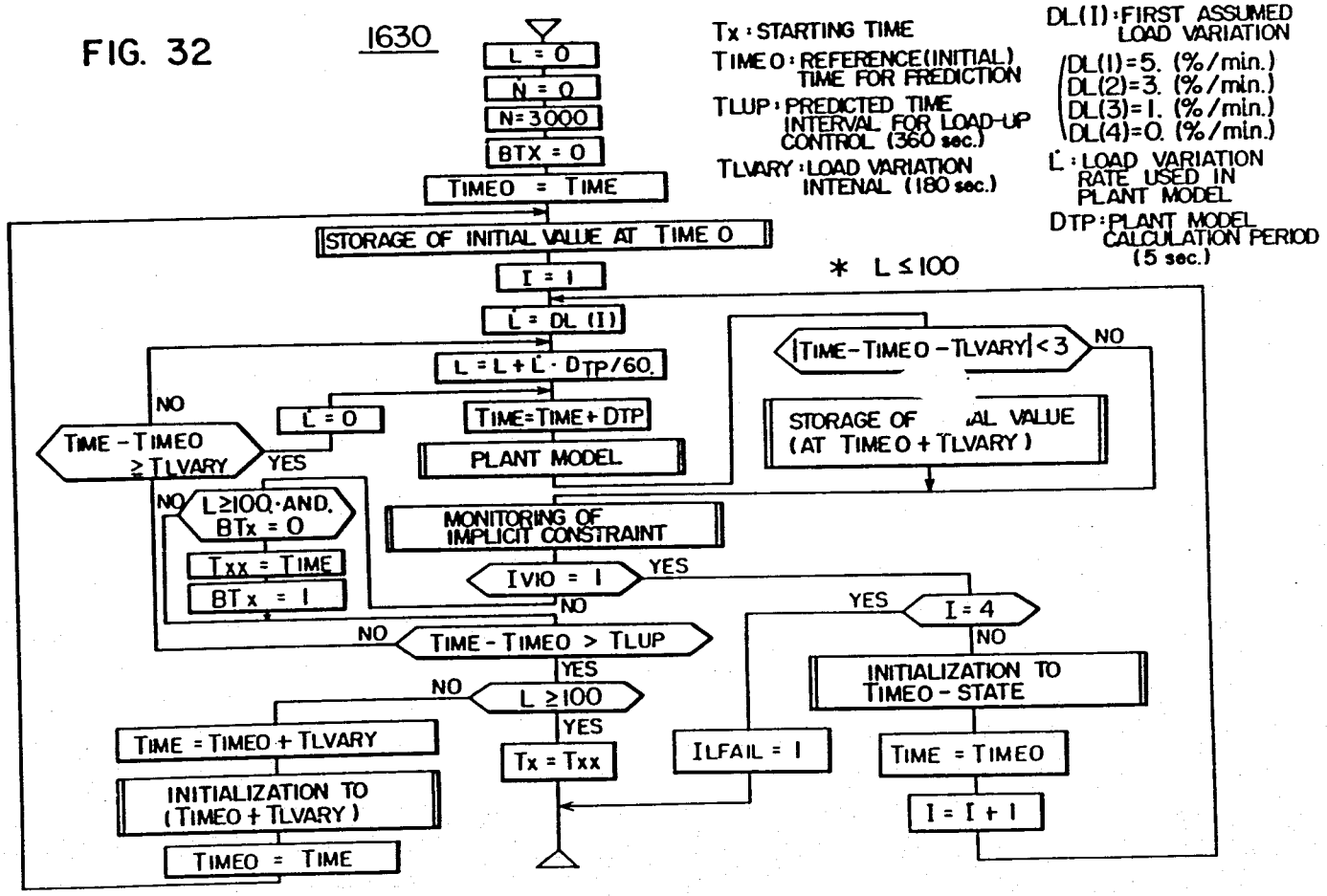
FIG. 32 is a flow chart illustrating a procedure for load-up control.

FIG. 32 illustrates a processing procedure for the load-up control which is basically similar to the speed-up control. According to the load-up procedure, an assumption is made that the load is increased at the maximum rate of variation of load DL(l) during the period $T_{LVARY}$ starting from the reference time point $T_{IMEO}$ and that the load is subsequently held at the attained level, and the stress which will be produced in the turbine during a period $T_{LUP}$ starting from the reference time point $T_{IMEO}$ is predicted. When the prediction indicate that the predicted value of stress is below the permissible level at any time point during the period $T_{LUP}$, the load-up is performed with the rate of change of load DL(1) actually (as a part of the start-up simulation). On the other hand, when the predicted stress value is beyond the permissible value, the rate of change of load DL(2) of the next lower rank is set on the model to predict the stress which will be produced. Unless the predicted stress goes below the permissible level even with the rate of change of load of the third lower rank, the rate of load variation DL(4) of the fourth lower rank is set to establish the load holding state. At the time point when the next control period $T_{NVARY}$ has been reached, this time point is set as the reference time point $T_{IMEO}$ to repeat the similar processing. When the target load is attained through repeated executions of the processing described above, the start-up operation comes to an end.

The starting time lapsed from the ignition of the boiler to the attainment of the target load for performing the procedures described above is represented by $T_X$.

Since the starting loss constitutes the objective for evaluation in the case of the first embodiment (FIG. 2A) and the second embodiment (FIG. 2B), the start-up schedule $X_Q$ and the starting time $T_{X,Q}$ which can assure minimum loss can be determined in both embodiments through the processing described above.

Further, the start-up at a predetermined time constitutes a factor to be controlled, a processing mentioned below is executed. The predicted time point at which the start-up operation is completed after the start-up procedure has been executed in accordance with the start-up schedule $X_Q$ assuring the minimum loss starting from the ignition of boiler at the time point $T_O$ is given by $$T_{PD}=T_O+T_{X,Q} \quad (10).$$

Accordingly, the plant is set to the stand-by state stepwise at the time interval of $\Delta T_1$ until the difference or error between the preset time point $T_{SET}$ at which the start-up operation is to be completed and the predicted time point $T_{PD}$ becomes below a permissible value $\epsilon$. When the error becomes smaller than the permissible value $\epsilon$, the minimum loss start-up schedule $X_Q$ is loaded in the schedule executing function 2000 as the optimum start-up schedule $X_{OPT}$. However, when the error between the set or designated time $T_{SET}$ and the predicted time $T_{PD}$ exceeds a predetermined value, the plant is set to the stand-by state only for a time interval $\Delta T_2$ to determine again the optimal start-up schedule, because otherwise the optimality of the start-up schedule could not be assured. In this connection, the time interval $\Delta T_2$ is so set that $\Delta T_2 < T_{SET} - T_{PD}$.

As will be appreciated from the foregoing description, the first embodiment of the present invention allows not only the minimization of loss accompanying the plant start-up but also realization of the start-up at a preset time point and hence can assure an improved effective thermal efficiency of the plant while enhancing the accuracy at which load of the power system is regulated. Further, the start-up at a preset time point allows advantageously the burden imposed on the operator to be reduced.

The second embodiment of the present invention is so implemented as to perform the processing described below for the purpose of realizing a minimum life reduction in addition to the low start-up loss. Referring to FIG. 2B, the predicted time point $T_{PD}$ at which the start-up has been completed by executing the minimum low schedule $X_Q$ starting from the time point $T_O$ at which the boiler is ignited is given by $$T_{PD} = T_O + T_{X,Q} \quad (11).$$

When error $\Delta T_X$ between a preset time point $T_{SET}$ at which the start-up will have to be completed and the predicted time point $T_{PD}$ mentioned above exceeds a permissible value $\epsilon$, the operation restricting conditions are corrected in dependence on the error $\Delta T_X$, whereby the start-up schedule assuring the minimum loss is again determined for the corrected restricting conditions. In this connection, it should be noted that the operation limiting conditions of concern are implicit constraints $Y_L(1)$ to $Y_L(16)$ illustrated in FIG. 5 which are collectively denoted by $Y_L$ in a vector form. In performing the correction, correcting functions corresponding to the limiting conditions, respectively, are prepared and also represented in vector forms $f(\Delta T_X)$. When the error $\Delta T_X$ becomes smaller than the permissible value $\epsilon$ by repeating the processing described above, the minimum loss start-up schedule $X_Q$ is transferred to the schedule executing function 2000 as the optimum start-up schedule $X_{OPT}$ which can assure realization of the start-up with minimum life reduction and loss.

According to the second embodiment of the present invention, the life of the plant which is frequently stopped and started can be prolonged because the life reduction of various instruments and machinery can be suppressed to a necessary minimum. Additionally, the starting loss involved in the start-up can be simultaneously reduced significantly, and energy-saving operation of the plant can be accomplished. Further, since the time point at which the start-up is to be completed coincides with the set or designated time point, the accuracy at which the load of the power system is regulated can be increased, which in turn enhances the reliability of the power supply, while allowing the burden imposed on the plant operators to be reduced.

In the case of the third embodiment of the invention, the starting time ($T_X$) is also subjected to evaluation. The start-up schedule prepared through the processing illustrated in FIG. 2C represents the optimal start-up schedule for solving the fundamental problem of achieving start-up within the shortest possible time.

More specifically, the third embodiment of the invention is destined to be primarily applied to the thermal power plant in which the intermediate pressure turbine preference start-up scheme and metal matching control are adopted. According to the optimum start-up schedule described hereinbefore, the lower limit temperature of the reheated steam supplied to the intermediate pressure turbine is arithmetically determined on the basis of the metal temperature of the intermediate pressure turbine. When the actually measured temperature of the reheated steam is higher than the calculated lower limit temperature, steam is supplied to the intermediate pressure turbine to perform the speed-up process. After the speed-up process is completed, the lower limit temperature of the main steam is arithmetically determined on the basis of the metal temperature of the high pressure turbine. When the actual main steam temperature is higher than the calculated lower temperature limit, main steam is admitted to the high pressure turbine, being followed by prediction of stress possibly produced in the turbine with the aid of the dynamic plant characteristic prediction model on the assumption that the initial load is thrown in. Then, a determination is made as to whether the predicted stress is lower than the permissible value. If the prediction shows that the stress is lower than the permissible value, insertion of additional load is carried out. Otherwise, steam admission to the high pressure turbine is not performed, and the no-load operation state is maintained. In the latter case, the condition permitting the steam admission is checked again through the above mentioned procedure after the lapse of a predetermined time, and the steam supply and insertion of load are again tried when the predicted stress is smaller than the permissible value.

In this way, the metal matching procedure can be executed in the ideal manner according to the third embodiment of the invention, whereby the plant starting time and in particular the time elapsing from the time point at which the steam admission to the intermediate pressure turbine is performed to the time point at which the steam admission to the high pressure turbine, and hence to the time point at which load is thrown in, can be significantly reduced. By virtue of these features, the load adjusting or regulating capability of the power system can be improved to assure an enhanced stability in the power supply. Further, in the individual power generating plants, the starting loss can be reduced because of reduction in the starting time, while the metal matching can be accomplished without fail to thereby assure the plant start-up with a high reliability with the burden on the operators being significantly reduced, to great advantages.

I claim:

1. A method of optimized start-up of a thermal power plant, said method comprising:

(a) preparing an initial start-up schedule for a thermal power plant based on given parameters relating to operation of the thermal power plant;

(b) preparing a dynamic characteristic model permitting simulation of start-up characteristics which would be obtained if the thermal power plant is started according to the initial start-up schedule;

(c) estimating the energy loss in start-up of the thermal power plant and the values of selected parameters relating to operation of the thermal power plant, based on the start-up characteristics obtained from the simulation using the prepared dynamic characteristic model according to the initial start-up schedule;

(d) determining whether the estimated values of the selected parameters are within predetermined allowable ranges or not;

(e) correcting the initial start-up schedule according to a predetermined rule depending on whether the estimated values are determined to be within the predetermined allowable ranges or not;

(f) repeating steps (c), (d), and (e) based on the corrected start-up schedule, thereby determining an optimized start-up schedule which makes the energy loss estimated by step (c) a minimum while maintaining the values of the selected parameters estimated by step (c) within the predetermined allowable ranges;

(g) estimating a time required for the thermal power plant to complete its start-up operation if the optimized start-up schedule is executed; and (h) applying the optimized start-up schedule to the thermal power plant at a time preceding a given time, when it is desired that the thermal power plant completes start-up, by the time estimated by step (g).

2. A method for preparing an optimized start-up time schedule for a thermal power plant of a type in which steam admission is first made to an intermediate pressure turbine, thereby speeding up the intermediate pressure turbine, and then made to a high pressure turbine after speeding up the intermediate pressure turbine, said method comprising:

(a) preparing an initial start-up time schedule defining scheduled timing of predetermined start-up operations and setting of target values required for starting the thermal power plant based on given parameters relating to the thermal power plant;

(b) preparing a dynamic characteristic model permitting simulation of start-up characteristics which would be obtained if the thermal power plant is started according to the initial start-up schedule;

(c) estimating a time interval between steam admission to the intermediate pressure turbine and steam admission to the high pressure turbine, and values of selected parameters including thermal stress of the thermal power plant from the simulation using the prepared dynamic characteristic model according to the initial start-up time schedule;

(d) determining whether the thermal stress is within a predetermined allowable range or not;

(e) correcting the initial start-up time schedule according to a predetermined rule depending on whether the thermal stress is determined to be within the predetermined allowable range or not; and (f) repeating steps (c), (d), and (e) based on the corrected start-up time schedule, thereby determining an optimized start-up time schedule which makes the time interval estimated by step (c) a minimum while maintaining the thermal stress estimated by step (c) within the predetermined allowable range.

3. A method according to claim 2, wherein:

the selected parameters include a reheated steam temperature, a lower limit temperature for metal matching of the intermediate pressure turbine represented by an equivalent reheated steam temperature, a main stream temperature, and a lower limit temperature of the high pressure turbine represented by an equivalent main stream temperature;

the start-up time schedule is further corrected in step (e) such that steam admission to the intermediate pressure turbine is made or delayed until the estimated reheated steam temperature reaches the estimated lower limit temperature, depending on whether the estimated reheated steam temperature is higher than the estimated lower limit temperature for metal matching or not, respectively; and when the estimated main steam temperature after speeding-up of the intermediate pressure turbine is higher than the estimated lower limit temperature for metal matching of the high pressure turbine, steam admission to the high pressure turbine is made or not, depending on whether the thermal stress of the turbine which would be obtained if the steam admission to the high pressure turbine is made is within the predetermined allowable range or not, respectively.

4. A method according to claim 2, further comprising applying the optimized start-up schedule to the thermal power plant.

5. A method for preparing an optimized start-up schedule for a thermal power plant, said method comprising:

(a) preparing an initial start-up time schedule for starting a thermal power plant based on given parameters relating to operating of the thermal power plant;

(b) estimating energy loss in the start-up of the thermal plant, a time point when the start-up of the thermal power plant will be finished, and values of selected parameters relating to operation of the thermal power plant which would be obtained if the thermal power plant is operated according to the initial start-up time schedule;

(c) determining whether the estimated values of the selected parameters and the deviation of the time point from a scheduled time point for finishing the start-up of the thermal power plant are within predetermined allowable ranges or not;

(d) correcting the initial start-up time schedule according to a predetermined rule depending on whether the estimated values and the deviation of the time point are determined to be within the predetermined allowable ranges or not; and (e) repeating steps (b), (c), and (d) based on the corrected start-up time schedule, thereby determining an optimized start-up time schedule which makes the energy less estimated by step (b) a minimum while maintaining the values of the selected parameters and the deviation of the time point estimated by step (b) within the predetermined allowable ranges.

6. A method according to claim 5, wherein said step (b) is carried out by simulating the start-up of the thermal power plant by using a dynamic characteristic model prepared for the purpose.

7. A method according to claim 5, further comprising applying the optimized start-up time schedule to the thermal power plant.

* * * * *